US008558640B2

(12) United States Patent
Hirai et al.

(10) Patent No.: US 8,558,640 B2
(45) Date of Patent: Oct. 15, 2013

(54) DIRECTIONAL COUPLER

(75) Inventors: Takami Hirai, Toyota (JP); Shinsuke Yano, Nagoya (JP); Takanobu Saka, Tajimi (JP)

(73) Assignee: NGK Insulators, Ltd., Nagoya (JP)

( * ) Notice: Subject to any disclaimer, the term of this patent is extended or adjusted under 35 U.S.C. 154(b) by 272 days.

(21) Appl. No.: 12/968,758

(22) Filed: Dec. 15, 2010

(65) Prior Publication Data

US 2011/0148544 A1 Jun. 23, 2011

Related U.S. Application Data

(60) Provisional application No. 61/287,769, filed on Dec. 18, 2009, provisional application No. 61/319,379, filed on Mar. 31, 2010.

(30) Foreign Application Priority Data

Oct. 22, 2010 (WO) ..... PCT/JP2010/068665

(51) Int. Cl.
*H01P 5/18* (2006.01)
*H01P 3/08* (2006.01)

(52) U.S. Cl.
USPC ..... 333/116; 333/111

(58) Field of Classification Search
USPC ..... 333/109, 110, 111, 112, 116, 238
See application file for complete search history.

(56) References Cited

U.S. PATENT DOCUMENTS

| | | | | |
|---|---|---|---|---|
| 4,999,593 | A | 3/1991 | Anderson | |
| 5,006,821 | A * | 4/1991 | Tam | 333/116 |
| 5,126,686 | A * | 6/1992 | Tam | 330/134 |
| 5,363,071 | A * | 11/1994 | Schwent et al. | 333/111 |
| 6,759,922 | B2 * | 7/2004 | Adar et al. | 333/109 |

FOREIGN PATENT DOCUMENTS

| | | | |
|---|---|---|---|
| JP | 04-505532 | | 9/1992 |
| JP | 05-014017 | | 1/1993 |
| JP | 05-041206 | A1 | 6/1993 |
| JP | 10-022707 | A1 | 1/1998 |
| JP | 11-261313 | A1 | 9/1999 |
| JP | 2002-280812 | A1 | 9/2002 |
| JP | 2005-168060 | | 6/2005 |
| JP | 2009-027617 | A1 | 2/2009 |

* cited by examiner

*Primary Examiner* — Dean O Takaoka
(74) *Attorney, Agent, or Firm* — Burr & Brown

(57) ABSTRACT

A directional coupler includes a dielectric substrate having at least an input terminal and an output terminal on a surface thereof, a main line disposed in the dielectric substrate and extending between the input terminal and the output terminal, a first coupling line for monitoring a level of an input signal which is input through the input terminal, the first coupling line being disposed in the dielectric substrate and having an end electrically connected to a first terminating resistor, and a second coupling line for monitoring a level of a reflected signal which is input through the output terminal, the second coupling line being disposed in the dielectric substrate and having an end electrically connected to a second terminating resistor.

28 Claims, 21 Drawing Sheets

DIRECTIONAL COUPLER

CROSS-REFERENCE TO RELATED APPLICATION

This application is based upon and claims the benefit of priority from U.S. Provisional Application Ser. No. 61/287,769 filed on Dec. 18, 2009 and Ser. No. 61/319,379 filed on Mar. 31, 2010, and International Application No. PCT/JP2010/068665 filed on Oct. 22, 2010, of which the contents are incorporated herein by reference.

BACKGROUND OF THE INVENTION

1. Field of the Invention

The present invention relates to a directional coupler.

2. Description of the Related Art

Recently, high-power radio-frequency transmitting apparatus are used in mobile phone base stations and industrial radio-frequency heating apparatus. The high-power radio-frequency transmitting apparatus amplify an input signal with a radio-frequency amplifier and send the amplified input signal via an antenna into air or a heating chamber.

It has been customary to position a directional coupler between a radio-frequency amplifier and an antenna to monitor the output signal of the radio-frequency amplifier for its magnitude or distortion, and adjust the gain of the radio-frequency amplifier so that it will not produce an output signal having a level higher than a standard level or adjust the input signal to the radio-frequency amplifier to remove distortions from the amplified signal.

Directional couplers disclosed in Japanese Laid-Open Patent Publication No. 2002-280812 and Japanese Laid-Open Patent Publication No. 2009-027617, for example, are known as directional couplers for monitoring the output signal of a radio-frequency amplifier.

According to the related art, there are known directional couplers having a structure which includes a coupling line in addition to a main line connected between an input terminal and an output terminal (see Japanese Laid-Open Utility Model Publication No. 05-041206, Japanese Laid-Open Patent Publication No. 10-022707, and Japanese Laid-Open Patent Publication No. 11-261313).

In mobile phone base stations or radio-frequency heating apparatus, an impedance mismatch may be developed to reflect a portion of a signal to be sent from an antenna back to a radio-frequency amplifier due to environmental changes such as weather changes around the antenna or conditions in the chamber of the radio-frequency heating apparatus. Such a reflected signal may tend to cause the radio-frequency amplifier to operate unstably or, in worst cases, to break down.

One protective countermeasure against such phenomena is to place an isolator between the radio-frequency amplifier and the antenna. The isolator protects the radio-frequency amplifier by sufficiently attenuating the signal reflected from the antenna before it reaches an output terminal of the radio-frequency amplifier. According to another solution, the radio-frequency amplifier is protected by monitoring the reflected signal and stopping the input signal from being applied to the radio-frequency amplifier or turning off the power supply of the radio-frequency amplifier without delay when some trouble is detected in the monitored signal. However, there has not been proposed yet any electronic component of simple structure which is capable of monitoring a reflected signal.

The directional couplers disclosed in Japanese Laid-Open Patent Publication No. 2002-280812 and Japanese Laid-Open Patent Publication No. 2009-027617 are designed to monitor the output signal, e.g., from a radio-frequency amplifier which is input to the directional coupler, but not to monitor the reflected signal. Similarly, the directional couplers disclosed in Japanese Laid-Open Utility Model Publication No. 05-041206, Japanese Laid-Open Patent Publication No. 10-022707, and Japanese Laid-Open Patent Publication No. 11-261313 are not designed to monitor the reflected signal though they are designed to be highly versatile for use in a plurality of frequency bands.

SUMMARY OF THE INVENTION

It is an object of the present invention to provide a directional coupler which is of a simple structure and is capable of monitoring an output signal from a radio-frequency amplifier or the like and also of monitoring a reflected signal from an antenna or the like.

[1] According to the present invention, there is provided a directional coupler comprising a dielectric substrate having at least an input terminal and an output terminal on a surface thereof, a main line disposed in the dielectric substrate and extending between the input terminal and the output terminal, a first coupling line for monitoring a level of an input signal which is input through the input terminal, the first coupling line being disposed in the dielectric substrate and having an end electrically connected to a first terminating resistor, and a second coupling line for monitoring a level of a reflected signal which is input through the output terminal, the second coupling line being disposed in the dielectric substrate and having an end electrically connected to a second terminating resistor.

[2] According to the present invention, the first coupling line may include at least a portion lying parallel to the main line, the second coupling line may include at least a portion lying parallel to the main line, the first terminating resistor may be connected to the end of the first coupling line which is close to the output terminal, and the second terminating resistor may be connected to the end of the second coupling line which is close to the input terminal.

[3] According to the present invention, the first coupling line and the second coupling line may lie parallel to the main line.

[4] According to the present invention, the first coupling line and the second coupling line may include portions not parallel to the main line.

[5] According to the present invention, the main line, the first coupling line, and the second coupling line may be disposed on one plane surface in the dielectric substrate.

[6] According to the present invention, the main line, the first coupling line, and the second coupling line may not be disposed on one plane surface in the dielectric substrate.

[7] According to the present invention, the main line may be disposed on a first plane surface in the dielectric substrate, the first coupling line may be disposed on a second plane surface different from the first plane surface in the dielectric substrate, and the second coupling line may be disposed on a third plane surface different from the first plane surface and the second plane surface in the dielectric substrate.

[8] According to the present invention, a portion of the first coupling line which is coupled to the main line and a portion of the second coupling line which is coupled to the main line may extend along the main line, and the portion of the first coupling line which is coupled to the main line and the portion of the second coupling line which is coupled to the main line may cross a plane perpendicular to the main line.

[9] According to the present invention, the first coupling line and the second coupling line may be axisymmetric with respect to the main line.

[10] According to the present invention, a shortest distance from the first coupling line to the input terminal and a shortest distance from the second coupling line to the input terminal may be different from each other.

[11] According to the present invention, the first coupling line may be disposed close to the input terminal, and the second coupling line may be disposed close to the output terminal.

[12] According to the present invention, the first coupling line and the second coupling line may have different lengths, respectively.

[13] According to the present invention, the length of the second coupling line may be greater than the length of the first coupling line.

[14] According to the present invention, a shortest distance from the first coupling line to the main line and a shortest distance from the second coupling line to the main line may be different from each other.

[15] According to the present invention, the shortest distance from the first coupling line to the main line may be greater than the shortest distance from the second coupling line to the main line.

[16] According to the present invention, the first coupling line and the second coupling line may have respective lengths which are not equal to each other, and a shortest distance from the first coupling line to the main line and a shortest distance from the second coupling line to the main line may not be equal to each other.

[17] According to the present invention, the length of the second coupling line may be greater than the length of the first coupling line, and the shortest distance from the first coupling line to the main line may be greater than the shortest distance from the second coupling line to the main line.

[18] According to the present invention, the directional coupler may further comprise a first monitor circuit for monitoring the level of the input signal, the first monitor circuit being electrically connected to another end of the first coupling line, and a second monitor circuit for monitoring the level of the reflected signal, the second monitor circuit being electrically connected to another end of the second coupling line.

[19] According to the present invention, the directional coupler may further comprise a first terminator connection terminal and a first monitor connection terminal which are disposed on a first side face of the dielectric substrate, a second terminator connection terminal and a second monitor connection terminal which are disposed on a second side face which is opposed to the first side face of the dielectric substrate, a first connection line electrically connecting the end of the first coupling line to the first terminator connection terminal, a second connection line electrically connecting the other end of the first coupling line to the first monitor connection terminal, a third connection line electrically connecting the end of the second coupling line to the second terminator connection terminal, and a fourth connection line electrically connecting the other end of the second coupling line to the second monitor connection terminal, wherein the first terminating resistor may be connected to the first terminator connection terminal, the first monitor circuit is connected to the first monitor connection terminal, the second terminating resistor may be connected to the second terminator connection terminal, and the second monitor circuit may be connected to the second monitor connection terminal.

[20] According to the present invention, the first connection line and the second connection line may extend perpendicularly to the main line and may have respective lengths greater than a length of a coupled portion of the main line and the first coupling line, and the third connection line and the fourth connection line may extend perpendicularly to the main line and may have respective lengths greater than the length of coupled portions of the main line and the second coupling line.

[21] According to the present invention, a portion of the first monitor circuit and a portion of the second monitor circuit may be mounted on an upper surface of the dielectric substrate.

[22] According to the present invention, a portion of the first monitor circuit, a portion of the second monitor circuit, the first terminating resistor, and the second terminating resistor may be mounted on an upper surface of the dielectric substrate.

[23] According to the present invention, the directional coupler may further comprise a first terminator connection terminal and a first monitor output terminal which are disposed on a first side face of the dielectric substrate, and a second terminator connection terminal and a second monitor output terminal which are disposed on a second side face which is opposed to the first side face of the dielectric substrate, wherein the portion of the first monitor circuit which is mounted on the upper surface of the dielectric substrate and the first monitor output terminal may be electrically connected to each other through an interconnect layer disposed on the upper surface of the dielectric substrate, the first terminating resistor which is mounted on the upper surface of the dielectric substrate and the first terminator connection terminal may be electrically connected to each other through an interconnect layer disposed on the upper surface of the dielectric substrate, the portion of the second monitor circuit which is mounted on the upper surface of the dielectric substrate and the second monitor output terminal may be electrically connected to each other through an interconnect layer disposed on the upper surface of the dielectric substrate, and the second terminating resistor which is mounted on the upper surface of the dielectric substrate and the second terminator connection terminal may be electrically connected to each other through an interconnect layer disposed on the upper surface of the dielectric substrate.

[24] According to the present invention, the first monitor circuit may include a first coupling capacitor connected to the other end of the first coupling line, the second monitor circuit may include a second coupling capacitor connected to the other end of the second coupling line, the first coupling capacitor may comprise a first electrode disposed in the dielectric substrate and connected to the other end of the first coupling line through a first via hole, a second electrode disposed in the dielectric substrate and connected to the portion of the first monitor circuit through a second via hole, and a dielectric layer interposed between the first electrode and the second electrode, and the second coupling capacitor may comprise a third electrode disposed in the dielectric substrate and connected to the other end of the second coupling line through a third via hole, a fourth electrode disposed in the dielectric substrate and connected to the portion of the second monitor circuit through a fourth via hole, and a dielectric layer interposed between the third electrode and the fourth electrode.

[25] According to the present invention, the directional coupler may further comprise a terminator connection terminal disposed on a side face of the dielectric substrate at a position near the input terminal, a monitor connection terminal disposed on the side face of the dielectric substrate at a position near the output terminal, an input connection line electrically connecting the end of the second coupling line which has at least a portion lying parallel to the main line, to the terminator connection terminal, and an output connection line electrically connecting another end of the second coupling line to the monitor connection terminal, wherein the first coupling line may include at least a portion lying parallel to the input connection line and has another end positioned near the main line.

[26] According to the present invention, the directional coupler may further comprise a third coupling line for monitoring the level of the reflected signal which is input through the output terminal, the third coupling line being disposed in the dielectric substrate and having an end electrically connected to a third terminating resistor, wherein the third coupling line includes at least a portion lying parallel to the output connection line and has another end positioned near the main line.

[27] According to the present invention, a shortest distance from the first coupling line to the second coupling line may be greater than a shortest distance from the third coupling line to the second coupling line.

[28] According to the present invention, the dielectric substrate may be made of ceramics.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE INVENTION

Recently, high-power radio-frequency transmitting apparatus are used in mobile phone base stations and industrial radio-frequency heating apparatus. The high-power radio-frequency transmitting apparatus amplify an input signal with a radio-frequency amplifier and send the amplified input signal into air via antenna or into a heating chamber.

In a mobile phone base station, a radio-frequency signal including communication data is amplified by a radio-frequency amplifier, and sent via a transmission and reception signal multiplexer from an antenna. The mobile phone base station thus communicates with mobile phone terminals located in an area that is covered by the mobile phone base station.

In order to effectively utilize frequencies assigned to the mobile phone base station and also to effectively utilize the electric power consumed by the mobile phone base station, it has been customary to extract a portion of the output signal from the radio-frequency amplifier with a directional coupler, measure the extracted signal for its magnitude or distortion, and adjust the input signal to the radio-frequency amplifier or adjust the gain of the radio-frequency amplifier.

Figure 1A:
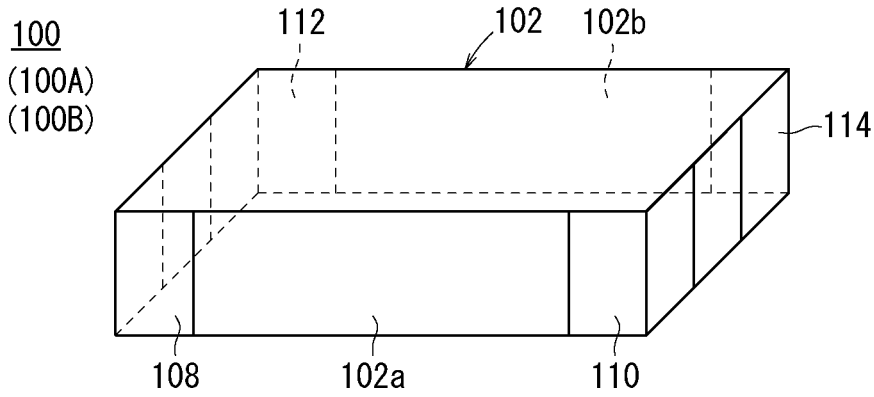
FIG. 1A is a perspective view of a directional coupler according to the related art.
Figure 1B:
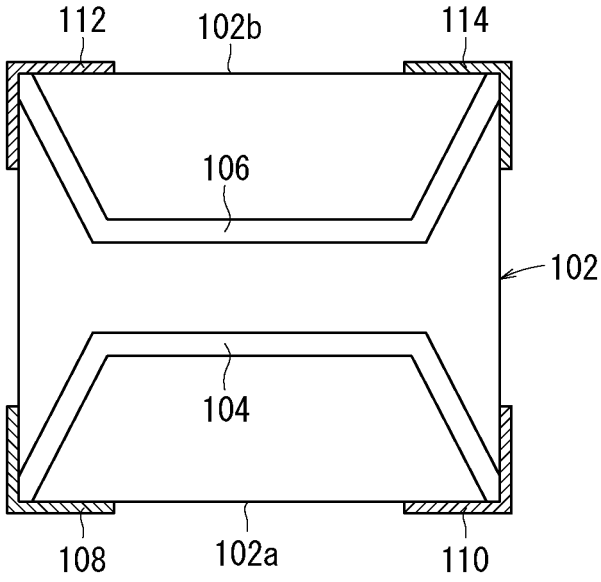
FIG. 1B is a plan view showing an example of various lines of the directional coupler according to the related art.

As shown in FIGS. 1A and 1B, a directional coupler 100 which is used in such a process comprises a dielectric substrate 102, a main line 104 disposed in the dielectric substrate 102, and a coupling line 106 which is electromagnetically coupled to the main line 104. As shown in FIG. 1A, the directional coupler 100 includes an input terminal 108 and an output terminal 110 on corners of a first side face 102*a* of the dielectric substrate 102, and a coupling terminal 112 and an isolation terminal 114 on corners of a second side face 102*b* which is opposed to the first side face 102*a*.

The main line 104 and the coupling line 106 are electromagnetically coupled to each other over a length that is adjusted to an about ¼ wavelength of a radio-frequency signal to be handled by the directional coupler 100. One (isolation terminal 114) of the opposite ends of the coupling line 106, which is close to the output of the directional coupler 100, is connected to a terminating resistor 116 (see FIG. 2).

It is thus possible to extract a portion of the input signal to the directional coupler 100 from the other end (coupling terminal 112) of the coupling line 106. The intensity ratio between the signal that is observed at the coupling terminal 112 and the input signal is referred to as a coupling value. A signal that is input from the output terminal 110 of the directional coupler 100 is virtually unobserved at the coupling terminal 112. The intensity ratio between the signal input from the output terminal 110 and the signal that is observed at the coupling terminal 112 is referred to as an isolation value which is smaller than the coupling value.

The coupler 100 is called as a directional coupler because the intensity ratio between the signal observed at the coupling terminal 112 and the signal input to the input terminal 108 and the intensity ratio between the signal observed at the coupling terminal 112 and the signal input from the output terminal 110 are different from each other.

A radio-frequency amplifier 120 (see FIG. 2) in a base station is associated with an antenna of the base station. Depending on environmental conditions around the antenna, the antenna has its input impedance varied and reflects a portion of a signal sent from the radio-frequency amplifier 120 back to the output terminal of the radio-frequency amplifier 120.

When the signal reflected from the antenna due to an impedance mismatch is input to the output terminal of the radio-frequency amplifier 120, the reflected signal tends to cause the radio-frequency amplifier 120 to operate unstably or, in worst cases, to break down.

One solution is to insert an isolator between the radio-frequency amplifier 120 and the antenna. However, since the isolator causes a large loss by itself, the power sent from the radio-frequency amplifier 120 suffers a large loss, and the isolator which can receive a high level of power from the mobile phone base station is large in size and highly expensive.

Figure 2:
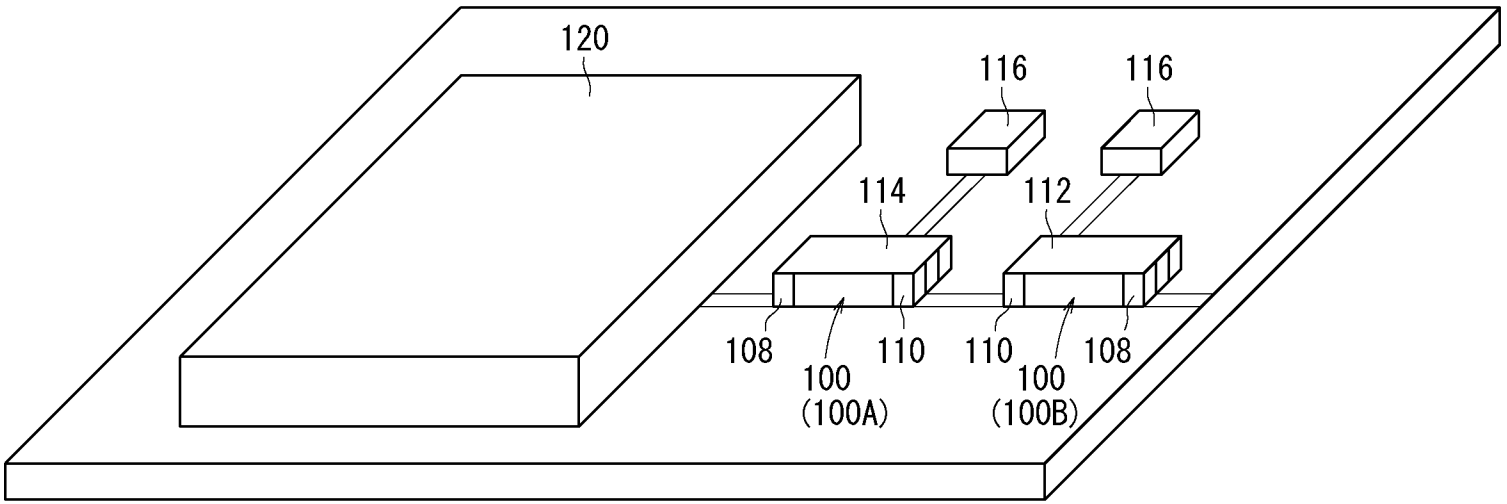
FIG. 2 is a perspective view of an example in which directional couplers according to the related art are mounted on a wiring board.

According to another solution to the problems of the reflected signal, than the isolator, as shown in FIG. 2, it has been proposed to position a directional coupler 100A for monitoring the output signal from the radio-frequency amplifier 120 between the radio-frequency amplifier 120 and the antenna and also to provide a directional coupler 100B for monitoring a reflected signal from the antenna. Though the directional coupler 100B is unable to prevent the output signal from the antenna from reaching the output terminal of the radio-frequency amplifier 120, it allows countermeasures to be taken, e.g., it allows the power supply of the radio-frequency amplifier 120 to be turned off when an excessive signal is observed, by monitoring a reflected signal. Since the directional coupler 100 is of a simple structure including the coupling line 106 disposed in the dielectric substrate 102, as described above, the directional coupler 100 can be fabricated with ease and can receive large radio-frequency power input thereto.

Nevertheless, as it is necessary to install the directional coupler 100A for detecting an output signal and the directional coupler 100B for detecting a reflected signal, the number of parts used is large and the area occupied thereby is also large.

The same problems occur in industrial radio-frequency heaters. In particular, since the impedance of the antenna of an industrial radio-frequency heater varies greatly depending on an object to be heated in the heating chamber, the ratio of the magnitude of the reflected signal is greater than with the mobile phone base stations. Consequently, it is important to employ a countermeasure for preventing the radio-frequency amplifier 120 from being affected by the reflected signal. Though the two directional couplers 100A, 100B disposed between the radio-frequency amplifier 120 and the antenna are effective, however, they inevitably make the number of parts used large and also make the area occupied thereby large.

Figure 3:
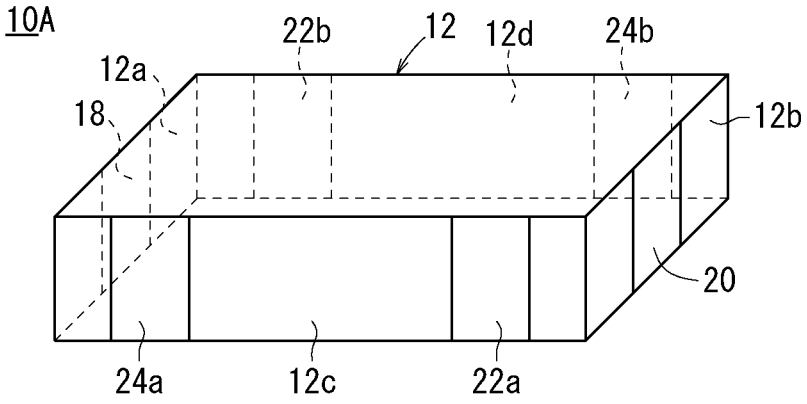
FIG. 3 is a perspective view of a first directional coupler.
Figure 4:
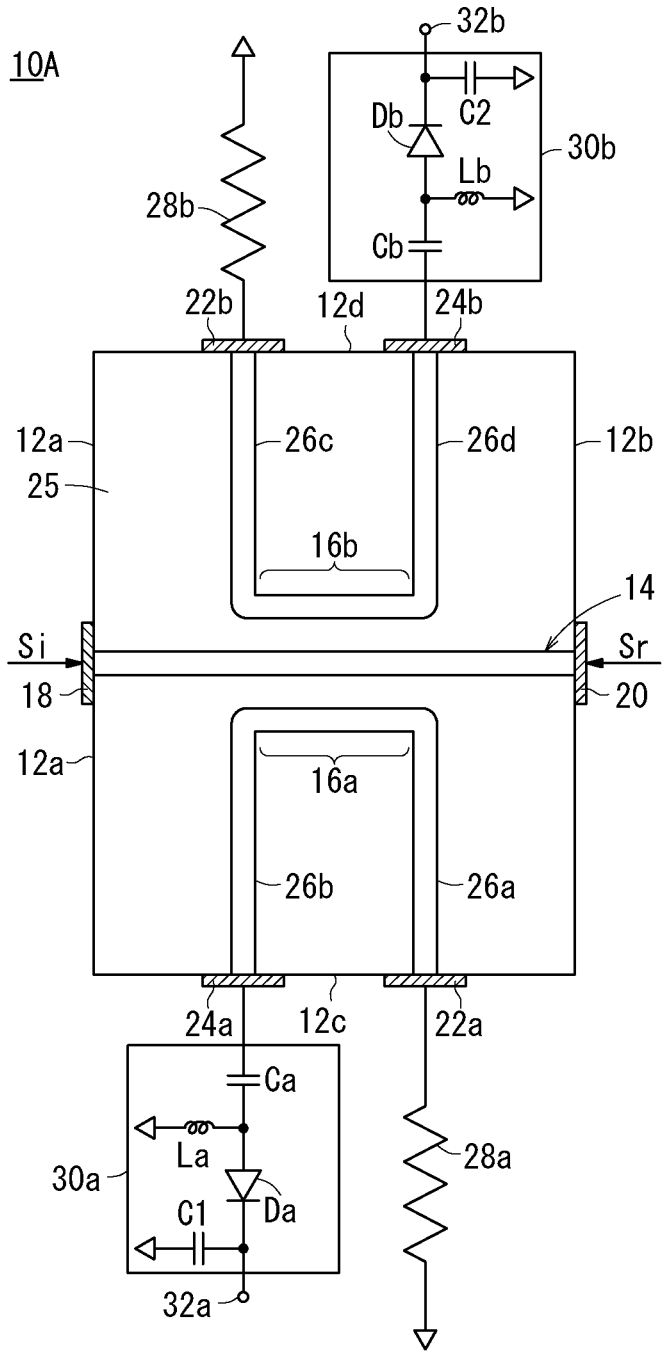
FIG. 4 is a plan view showing an example of various lines of the first directional coupler.

As shown in FIGS. 3 and 4, a directional coupler according to a first embodiment (hereinafter referred to as "first directional coupler 10A") is a distributed-constant directional coupler including a dielectric substrate 12, a main line 14 disposed in the dielectric substrate 12, and two coupling lines (a first coupling line 16*a* and a second coupling line 16*b*) which are electromagnetically coupled to the main line 14. The first directional coupler 10A has a wide frequency range and causes a low loss.

Specifically, the first directional coupler 10A also includes an input terminal 18 disposed on a first side face 12*a* of the dielectric substrate 12 and an output terminal 20 disposed on a second side face 12*b* which is opposed to the first side face 12*a*. The first directional coupler 10A also includes a first terminator connection terminal 22*a* disposed on a third side face 12*c* and connected to an end of the first coupling line 16*a* (near the output terminal 20) and a first monitor connection terminal 24*a* disposed on the third side face 12*c* and connected to the other end of the first coupling line 16*a* (near the input terminal 18). The first terminator connection terminal 22*a* is connected to the end of the first coupling line 16*a* (near the output terminal 20) through a first connection line 26*a*. The first monitor connection terminal 24*a* is connected to the other end of the first coupling line 16*a* (near the input terminal 18) through a second connection line 26*b*.

Similarly, the first directional coupler 10A also includes a second terminator connection terminal 22*b* disposed on a fourth side face 12*d* which is opposed to the third side face 12*c* and connected to an end of the second coupling line 16*b* (near the input terminal 18) and a second monitor connection terminal 24*b* disposed on the fourth side face 12*d* and connected to the other end of the second coupling line 16*b* (near the output terminal 20). The second terminator connection terminal 22*b* is connected to the end of the second coupling line 16*b* through a third connection line 26*c*. The second monitor connection terminal 24*b* is connected to the other end of the second coupling line 16*b* through a fourth connection line 26*d*.

The main line 14, the first coupling line 16*a*, the second coupling line 16*b*, and the first through fourth connection lines 26*a* through 26*d* are disposed on a plane surface 25 in the dielectric substrate 12. The first coupling line 16*a* extends parallel to the main line 14 and is disposed adjacent to the main line 14. The second coupling line 16*b* extends parallel to the main line 14 and is disposed adjacent to the main line 14. The first coupling line 16*a* and the second coupling line 16*b* are axisymmetric with respect to the main line 14.

The main line 14 and the first coupling line 16*a* are electromagnetically coupled to each other and the main line 14 and the second coupling line 16*b* are electromagnetically coupled to each other, over a length that is adjusted to an about ¼ wavelength of a radio-frequency signal to be handled by the first directional coupler 10A. Since the wavelength of a signal in the dielectric substrate 12 is in inverse proportion to the square root of the dielectric constant of the dielectric substrate 12, the dielectric substrate 12 is generally made of ceramics having a high dielectric constant for the purpose of making the first directional coupler 10A smaller in size.

The first through fourth connection lines 26*a* through 26*d* extend perpendicularly to the main line 14. The first connection line 26*a* and the second connection line 26*b* which are connected to the first coupling line 16*a*, and the third connection line 26*c* and the fourth connection line 26*d* which are connected to the second coupling line 16*b* extend in opposite directions. The first connection line 26*a* and the second connection line 26*b* have respective lengths equal to or greater than the length over which the main line 14 and the first coupling line 16*a* are coupled to each other. The third connection line 26*c* and the fourth connection line 26*d* have respective lengths equal to or greater than the length over which the main line 14 and the second coupling line 16*b* are coupled to each other.

The first directional coupler 10A further includes a first terminating resistor 28*a* electrically connected to an end of the first coupling line 16*a* and a second terminating resistor 28*b* electrically connected to an end of the second coupling line 16*b*. The first directional coupler 10A further includes a first monitor circuit 30*a* connected to the other end of the first coupling line 16*a* and a second monitor circuit 30*b* connected to the other end of the second coupling line 16*b*. Specifically, the first terminating resistor 28*a* is connected to an end of the first coupling line 16*a* through the first connection line 26*a* and the first terminator connection terminal 22*a*, and the first monitor circuit 30*a* is connected to the other end of the first coupling line 16*a* through the second connection line 26*b* and the first monitor connection terminal 24*a*. Similarly, the second terminating resistor 28*b* is connected to an end of the second coupling line 16*b* through the third connection line 26*c* and the second terminator connection terminal 22*b*, and the second monitor circuit 30*b* is connected to the other end of the second coupling line 16*b* through the fourth connection line 26*d* and the second monitor connection terminal 24*b*.

The first monitor circuit 30*a* is a circuit for monitoring the level (input level) of an input signal Si (the output signal from a radio-frequency amplifier or the like) that is input via the input terminal 18. The first monitor circuit 30*a* comprises a first coupling capacitor Ca and a first PIN diode Da which are connected between the first monitor connection terminal 24*a* and a first monitor output terminal 32*a*, a first inductor La serving as a biasing circuit for the first PIN diode Da, and a first capacitor C1 for storing a detected current from the first PIN diode Da as an electric charge and outputting the stored electric charge as a detected rectified signal (a signal representing the input level: current and voltage).

The second monitor circuit 30*b* is a circuit for monitoring the level (reflected level) of a reflected signal Sr that is input via the output terminal 20. As with the first monitor circuit 30*a*, the second monitor circuit 30*b* comprises a second coupling capacitor Cb and a second PIN diode Db which are connected between the second monitor connection terminal 24*b* and a second monitor output terminal 32*b*, a second inductor Lb serving as a biasing circuit for the second PIN diode Db, and a second capacitor C2 for storing a detected current from the second PIN diode Db as an electric charge and outputting the stored electric charge as a detected rectified signal (a signal representing the reflected level: current and voltage).

Figure 5:
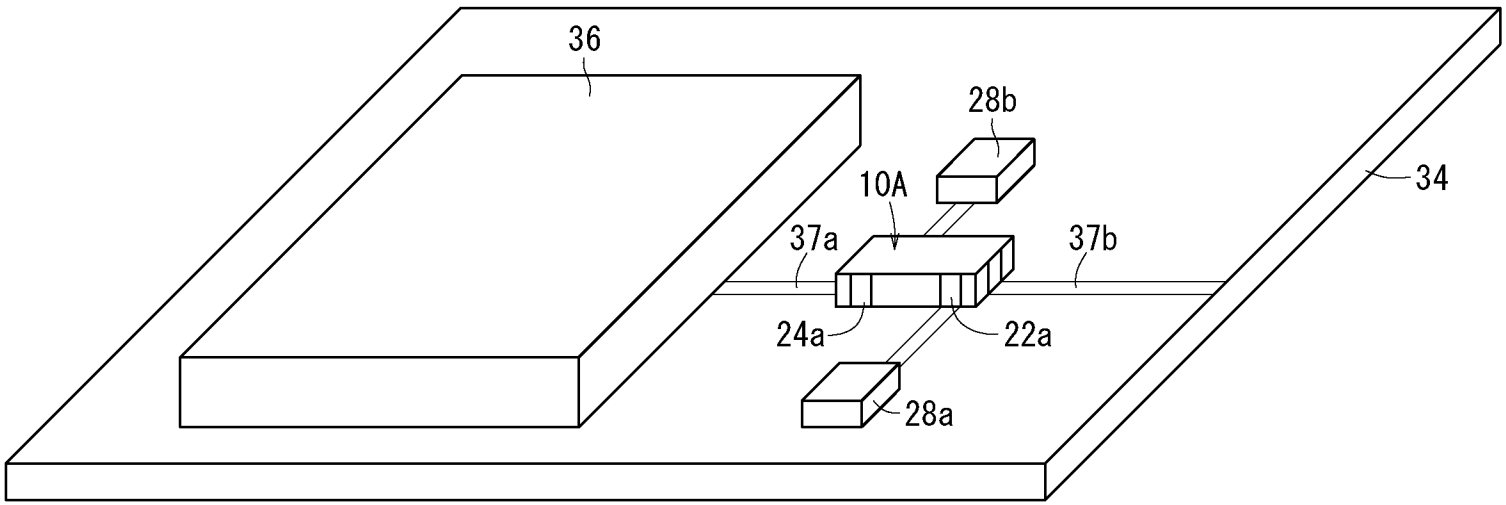
FIG. 5 is a perspective view of an example in which the first directional coupler is mounted on a wiring board.

As shown in FIG. 5, when the first directional coupler 10A is mounted on a wiring board 34, the first directional coupler 10A is positioned between a radio-frequency amplifier 36 and an antenna, not shown. In FIG. 5, the first monitor circuit 30*a* and the second monitor circuit 30*b* are omitted from illustration.

Operation of the first directional coupler 10A will be described below with reference to FIG. 6.

It is assumed that the input level is 100 W (=50 dBm), the level of a first coupling (the coupling between the main line 14 and the first coupling line 16*a*) is 30 dB, the level of a first isolation (the isolation between the main line 14 and the first coupling line 16*a*) is 60 dB, the level of a first directionality (the directionality between the main line 14 and the first coupling line 16*a*) is 30 dB, the level of a second coupling (the coupling between the main line 14 and the second coupling line 16*b*) is 30 dB, the level of a second isolation (the isolation between the main line 14 and the second coupling line 16*b*) is 60 dB, and the level of a second directionality (the directionality between the main line 14 and the second coupling line 16*b*) is 30 dB. It is also assumed that the reflected level is 1% of the input level (=1 W (30 dBm)) as the reflected level varies depending on a mismatch with the antenna or the like.

First, (a): in response to the input level of 50 dBm, the other end of the first coupling line 16*a* near the input terminal 18, i.e., the first monitor connection terminal 24*a*, produces (b): a signal (input monitor signal Sia) having a level of 20 dBm which represents the difference generated by subtracting the level of the first coupling which is 30 dB from the input level of 50 dBm, and (c): a signal (reflection leakage signal Sra) having a level of −30 dBm which represents the difference generated by subtracting the level of the first isolation which is 60 dB from the reflected level of 30 dBm. Since the reflected level is greatly attenuated by the first isolation, the other end of the first coupling line 16*a* near the input terminal 18, i.e., the first monitor connection terminal 24*a*, essentially produces only the input monitor signal Sia, thus making it possible to monitor the input signal Si to the first directional coupler 10A.

Then, (d): in response to the reflected level of 30 dBm, the end of the second coupling line 16*b* near the output terminal 20, i.e., the second monitor connection terminal 24*b* produces (e): a signal (reflection monitor signal Srb) having a level of 0 dBm which represents the difference generated by subtracting the level of the second coupling which is 30 dB from the reflected level of 30 dBm, and (f): a signal (input leakage signal Sib) having a level of −10 dBm which represents the difference generated by subtracting the level of the second isolation which is 60 dB from the input level of 50 dBm. Since the input level is greatly attenuated by the second isolation, the other end of the second coupling line 16*b* near the output terminal 20, i.e., the second monitor connection terminal 24*b*, essentially produces only the reflection monitor signal Srb, thus making it possible to monitor the reflected signal Sr to the first directional coupler 10A.

The output level from the first monitor connection terminal 24*a* has a difference of 50 dB (one-hundred-thousandth) with the level (input monitor level) of the input monitor signal Sia which is 20 dBm because the level (reflection leakage level) of the reflection leakage signal Sra is −30 dBm. Therefore, the effect that the reflected signal Sr has on the evaluation of the level of the input signal Si is small. The output level from the second monitor connection terminal 24*b* has a difference of 10 dB (one-tenth) with the level (input leakage level) of the input leakage signal Sib which is −10 dBm because the level (reflection monitor level) of the reflection monitor signal Srb is 0 dBm. Therefore, though the input signal Si has an effect on the reflected signal Sr, the first directional coupler 10A has a function to monitor the reflected signal Sr.

Since the first coupling line 16*a* can be used to monitor the output signal from the radio-frequency amplifier 36 and the second coupling line 16*b* can be used to monitor the reflected signal Sr, the first directional coupler 10A has a reduced number of parts used and a reduced area occupied thereby, as shown in FIG. 5. Furthermore, the first directional coupler 10A has a reduced overall loss because the main line for propagating signals is shorter than if two directional couplers 100 shown in FIG. 1 are employed (see FIG. 2).

In particular, inasmuch as the first through fourth connection lines 26*a* through 26*d* extend perpendicularly to the main line 14, the first connection line 26*a* and the second connection line 26*b*, and the third connection line 26*c* and the fourth connection line 26*d* extend in opposite directions, the first connection line 26*a* and the second connection line 26*b* have respective lengths equal to or greater than the length over which the main line 14 and the first coupling line 16*a* are coupled to each other, and the third connection line 26*c* and the fourth connection line 26*d* have respective lengths equal to or greater than the length over which the main line 14 and the second coupling line 16*b* are coupled to each other, any unwanted coupling between the first monitor connection terminal 24*a* and the second monitor connection terminal 24*b* is reduced. As a result, the reflected signal Sr is prevented from leaking into the first coupling line 16*a*, and the input signal Si is prevented from leaking into the second coupling line 16*b*.

More preferably, in FIG. 5, wiring 37*a* between the radio-frequency amplifier 36 and the first directional coupler 10A, or wiring 37*b* which extends from the first directional coupler 10A in the opposite direction to the radio-frequency amplifier 36, may be covered with a shield electrode (for example, while interposing an insulation layer, an insulation board, or the like between the wiring and the shield electrode) that is connected to a ground plate or a ground electrode, so that the shield electrode has the same potential as the GND potential (a reference potential such as 0 V, which is applied to an unillustrated ground plate or an unillustrated ground electrode provided on the wiring board) of the wiring board 34. Thus, it is possible to prevent the input signal Si and the reflected signal Sr from being directly coupled to the first monitor connection terminal 24*a* and the second monitor connection terminal 24*b* through the wiring 37*a* and the wiring 37*b*.

Similar advantageous effects can be achieved by covering the wiring between the first monitor connection terminal 24*a* and the first monitor circuit 30*a*, or the wiring between the second monitor connection terminal 24*b* and the second monitor circuit 30*b*, with the shield electrode. The purpose of the shield electrode is to prevent the input signal Si from being directly coupled to the second monitor circuit 30*b* and/or to prevent the reflected signal Sr from being directly coupled to the first monitor circuit 30*a*, without flowing through the inside of the first directional coupler 10A. Therefore, in the first directional coupler 10A, it is only necessary to electrically insulate a region including the input terminal 18 and the first monitor circuit 30*a* from a region including the output terminal 20 and the second monitor circuit 30*b*, and vice versa.

A directional coupler according to a second embodiment (hereinafter referred to as "second directional coupler 10B") will be described below with reference to FIGS. 7 through 9B.

Figure 7:
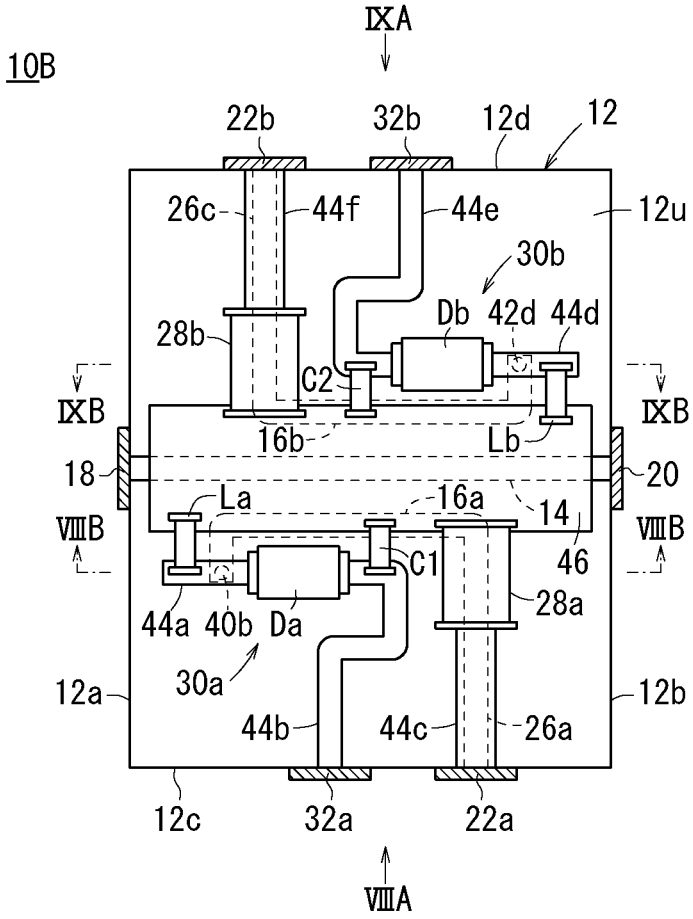
FIG. 7 is a plan view of a second directional coupler.
Figure 8A:
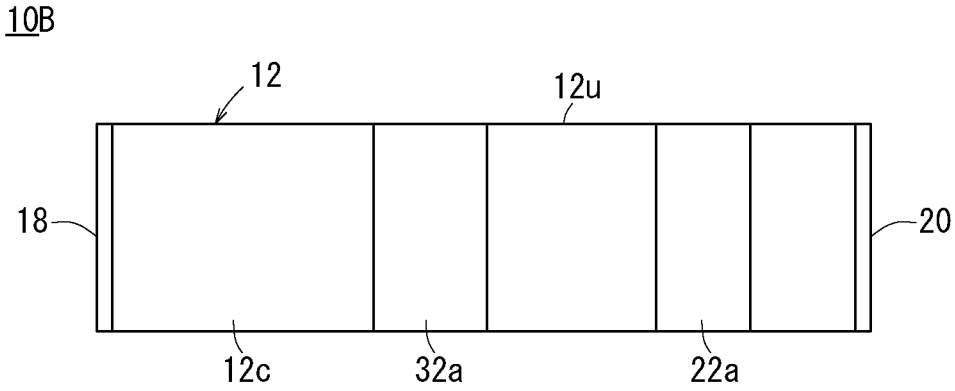
FIG. 8A is a side elevational view, partly omitted from illustration, of the second directional coupler as viewed along the arrow VIIIA of FIG. 7.
Figure 9A:
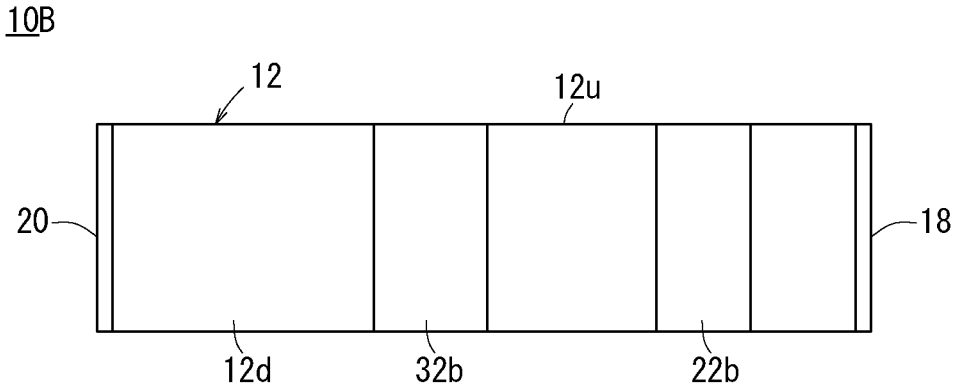
FIG. 9A is a side elevational view, partly omitted from illustration, of the second directional coupler as viewed along the arrow IXA of FIG. 7.

The second directional coupler 10B is substantially similar in structure to the first directional coupler 10A described above, but is different therefrom as follows:

As shown in FIGS. 7 and 8A, a first terminator connection terminal 22*a* and a first monitor output terminal 32*a* are disposed on a third side face 12*c* of a dielectric substrate 12. As shown in FIGS. 7 and 9A, a second terminator connection terminal 22*b* and a second monitor output terminal 32*b* are disposed on a fourth side face 12*d* of the dielectric substrate 12.

A portion of a first monitor circuit 30*a*, a portion of a second monitor circuit 30*b*, a first terminating resistor 28*a*, and a second terminating resistor 28*b* are mounted on an upper surface 12*u* of the dielectric substrate 12.

Figure 8B:
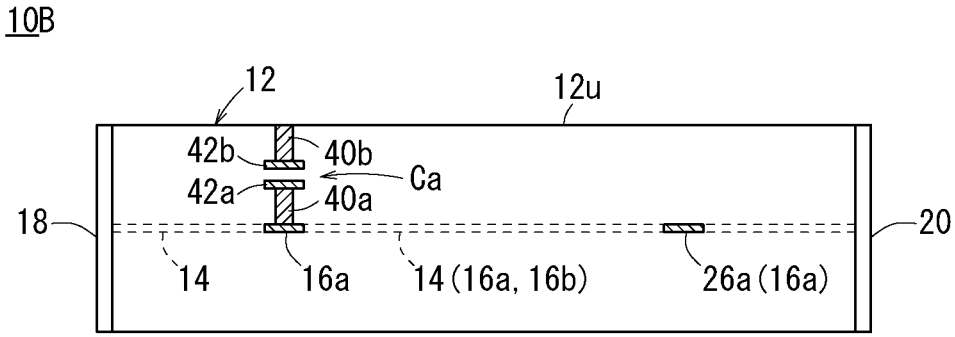
FIG. 8B is a cross-sectional view, partly omitted from illustration, taken along line VIIIB-VIIIB of FIG. 7.

Specifically, as shown in FIGS. 7 and 8B, the first monitor circuit 30*a* has a first coupling capacitor Ca disposed in the dielectric substrate 12, and the portion of the first monitor circuit 30*a* (a first inductor La, a first PIN diode Da, and a first capacitor C1) and the first terminating resistor 28*a* are mounted on the upper surface 12*u* of the dielectric substrate 12. In FIGS. 8A and 8B, the portion of the first monitor circuit 30*a* and the first terminating resistor 28*a* are omitted from illustration.

As shown in FIG. 8B, the first coupling capacitor Ca comprises a first electrode 42*a* connected to the other end of the first coupling line 16*a* through a first via hole 40*a*, a second electrode 42*b* connected to the portion of the first monitor circuit 30*a* through a second via hole 40*b*, and a dielectric layer interposed between the first electrode 42*a* and the second electrode 42*b*.

The second via hole 40*b*, an end of the first inductor La, and an end of the first PIN diode Da are electrically connected to each other by a first interconnect layer 44*a* on the upper surface 12*u* of the dielectric substrate 12. The other end of the first PIN diode Da, an end of the first capacitor C1, and the first monitor output terminal 32*a* are electrically connected to each other by a second interconnect layer 44*b* on the upper surface 12*u* of the dielectric substrate 12. An end of the first terminating resistor 28*a* and the first terminator connection terminal 22*a* are electrically connected to each other by a third interconnect layer 44*c* on the upper surface 12*u* of the dielectric substrate 12. The other end of the first inductor La, the other end of the first capacitor C1, and the other end of the first terminating resistor 28*a* are electrically connected to a shield terminal 46 (to which a reference potential (e.g., a ground potential) is applied) on the upper surface 12*u* of the dielectric substrate 12.

Figure 9B:
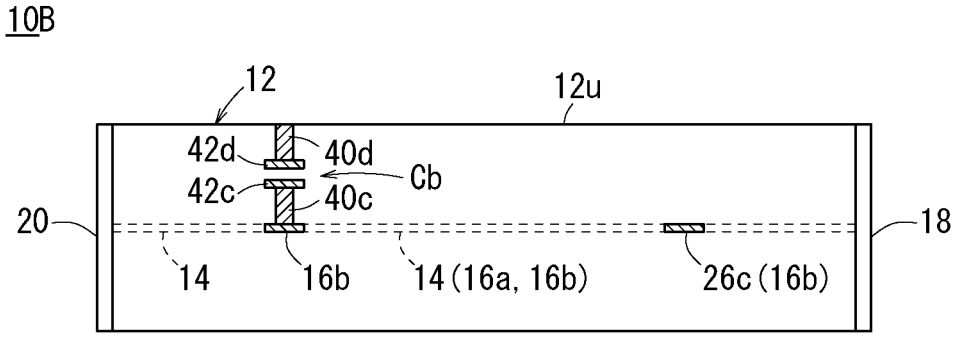
FIG. 9B is a cross-sectional view, partly omitted from illustration, taken along line IXB-IXB of FIG. 7.

Likewise, as shown in FIGS. 7 and 9B, the second monitor circuit 30*b* has a second coupling capacitor Cb disposed in the dielectric substrate 12, and the portion of the second monitor circuit 30*b* (a second inductor Lb, a second PIN diode Db, and a second capacitor C2) and the second terminating resistor 28*b* are mounted on the upper surface 12*u* of the dielectric substrate 12. In FIGS. 9A and 9B, the portion of the second monitor circuit 30*b* and the second terminating resistor 28*b* are omitted from illustration.

As shown in FIG. 9B, the second coupling capacitor Cb comprises a third electrode 42*c* connected to the other end of the second coupling line 16*b* through a third via hole 40*c*, a fourth electrode 42*d* connected to the portion of the second monitor circuit 30*b* through a fourth via hole 40*d*, and a dielectric layer interposed between the third electrode 42*c* and the fourth electrode 42*d*.

The fourth via hole 40*d*, an end of the second inductor Lb, and an end of the second PIN diode Db are electrically connected to each other by a fourth interconnect layer 44*d* on the upper surface 12*u* of the dielectric substrate 12. The other end of the second PIN diode Db, an end of the second capacitor C2, and the second monitor output terminal 32*b* are electrically connected to each other by a fifth interconnect layer 44*e* on the upper surface 12*u* of the dielectric substrate 12. An end of the second terminating resistor 28*b* and the second terminator connection terminal 22*b* are electrically connected to each other by a sixth interconnect layer 44*f* on the upper surface 12*u* of the dielectric substrate 12. The other end of the second inductor Lb, the other end of the second capacitor C2, and the other end of the second terminating resistor 28*b* are electrically connected to the shield terminal 46.

Since the first monitor circuit 30*a*, the second monitor circuit 30*b*, the first terminating resistor 28*a*, and the second terminating resistor 28*b* are mounted on the dielectric substrate 12, the area in which the second directional coupler 10B is mounted on the wiring board 34 is greatly reduced, contributing to efforts to make communication devices, etc. smaller in size.

A directional coupler according to a third embodiment (hereinafter referred to as "third directional coupler 10C") will be described below with reference to FIGS. 10A and 10B.

Figure 10A:
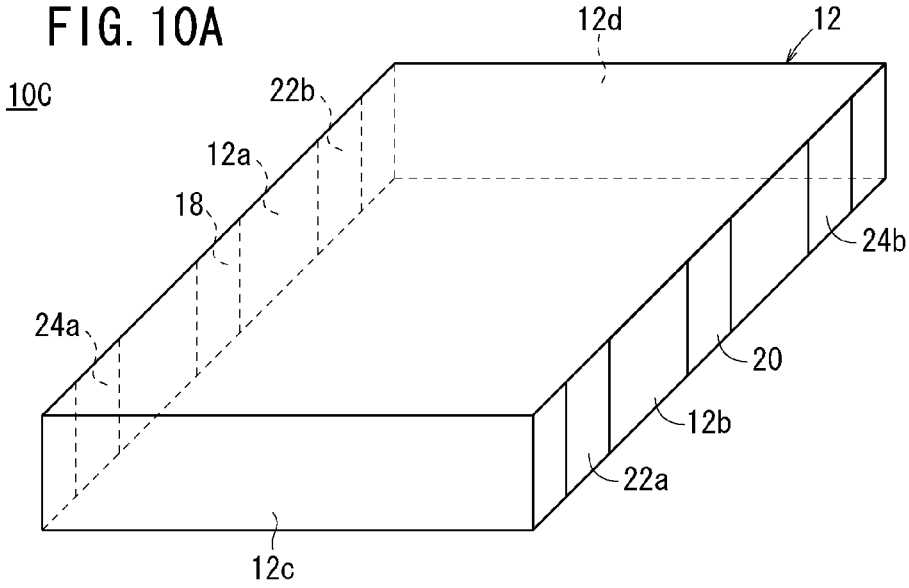
FIG. 10A is a perspective view of a third directional coupler.
Figure 10B:
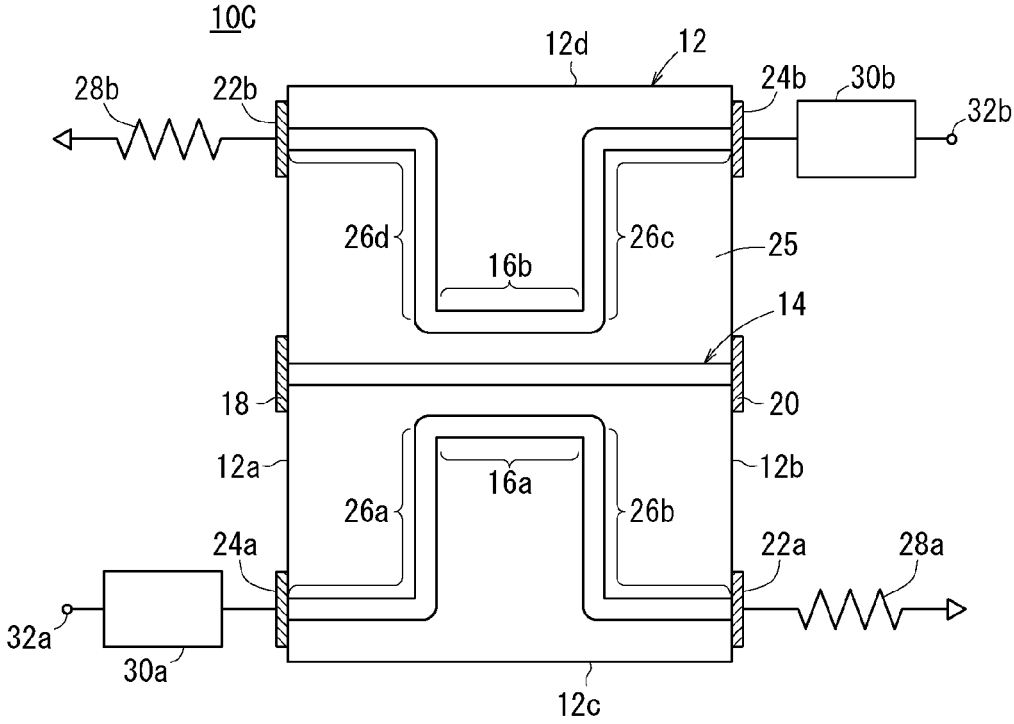
FIG. 10B is a plan view showing an example of various lines of the third directional coupler.

The third directional coupler 10C is substantially similar in structure to the first directional coupler 10A described above, but is different therefrom in that, as shown in FIGS. 10A and 10B, the first monitor connection terminal 24*a* and the second terminator connection terminal 22*b* as well as the input terminal 18 are disposed on the first side face 12*a* of the dielectric substrate 12, and the first terminator connection terminal 22*a* and the second monitor connection terminal 24*b* as well as the output terminal 20 are disposed on the second side face 12*b* of the dielectric substrate 12, thereby increasing the lengths of the first through fourth connection lines 26*a* through 26*d*.

With this arrangement, any unwanted coupling between the first monitor connection terminal 24*a* and the second monitor connection terminal 24*b* is further reduced.

A directional coupler according to a fourth embodiment (hereinafter referred to as "fourth directional coupler 10D") will be described below with reference to FIG. 11.

Figure 11:
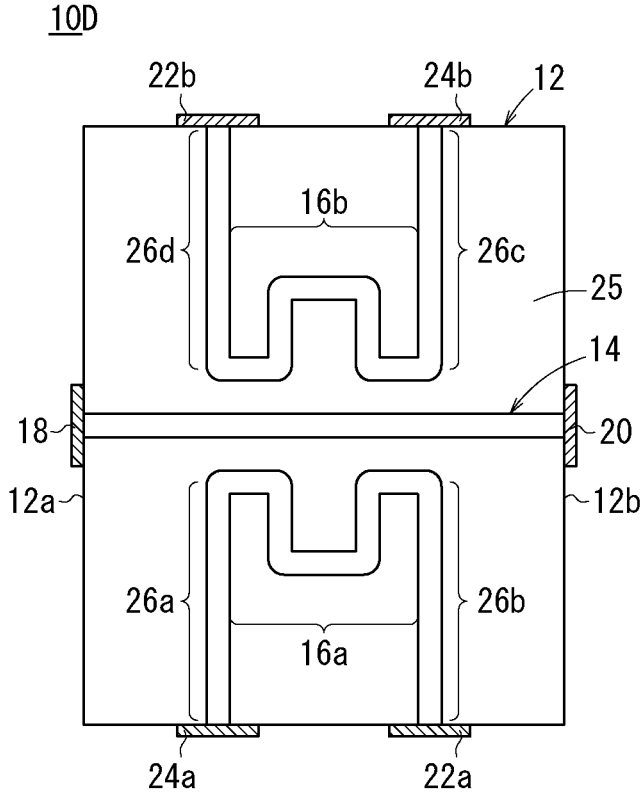
FIG. 11 is a plan view showing an example of various lines of a fourth directional coupler.

The fourth directional coupler 10D is substantially similar in structure to the first directional coupler 10A described above, but is different therefrom in that, as shown in FIG. 11, the first coupling line 16*a* comprises a combination of portions extending parallel to and not parallel to the main line 14, and similarly the second coupling line 16*b* comprises a combination of portions extending parallel to and not parallel to the main line 14.

For controlling the radio-frequency amplifier 36 using the input signal Si and the reflected signal Sr, it is advantageous that the intensity ratio between the monitored signal and the input signal is free of frequency characteristics in the frequency range in use. Since the fourth directional coupler 10D is arranged as described above, the intensity ratio of the monitored signal is stable against the frequency axis.

A directional coupler according to a fifth embodiment (hereinafter referred to as "fifth directional coupler 10E") will be described below with reference to FIG. 12.

Figure 12:
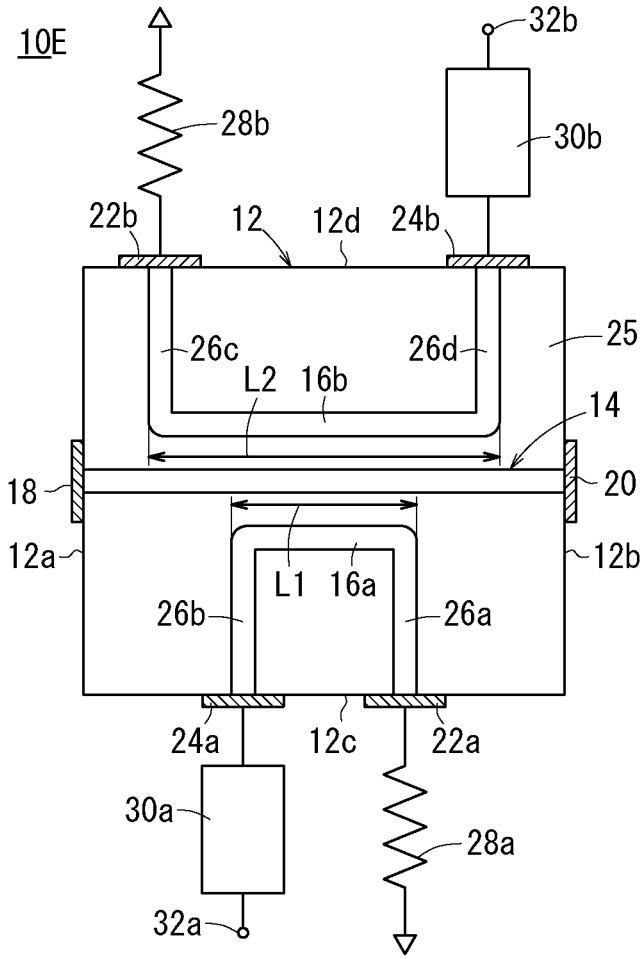
FIG. 12 is a plan view showing an example of various lines of a fifth directional coupler.

The fifth directional coupler 10E is substantially similar in structure to the first directional coupler 10A described above, but is different therefrom in that, as shown in FIG. 12, the second coupling line 16*b* is longer than the first coupling line 16*a*. Specifically, if the main line 14 and the first coupling line 16*a* have a first coupling length L1 and the main line 14 and the second coupling line 16*b* have a second coupling length L2, then the first coupling length L1 and the second coupling length L2 are related to each other as L2>L1. For example, L2=(¾)λ and L1=(¼)λ.

Operation of the fifth directional coupler 10E will be described below with reference to FIGS. 6 and 12.

Figure 6:
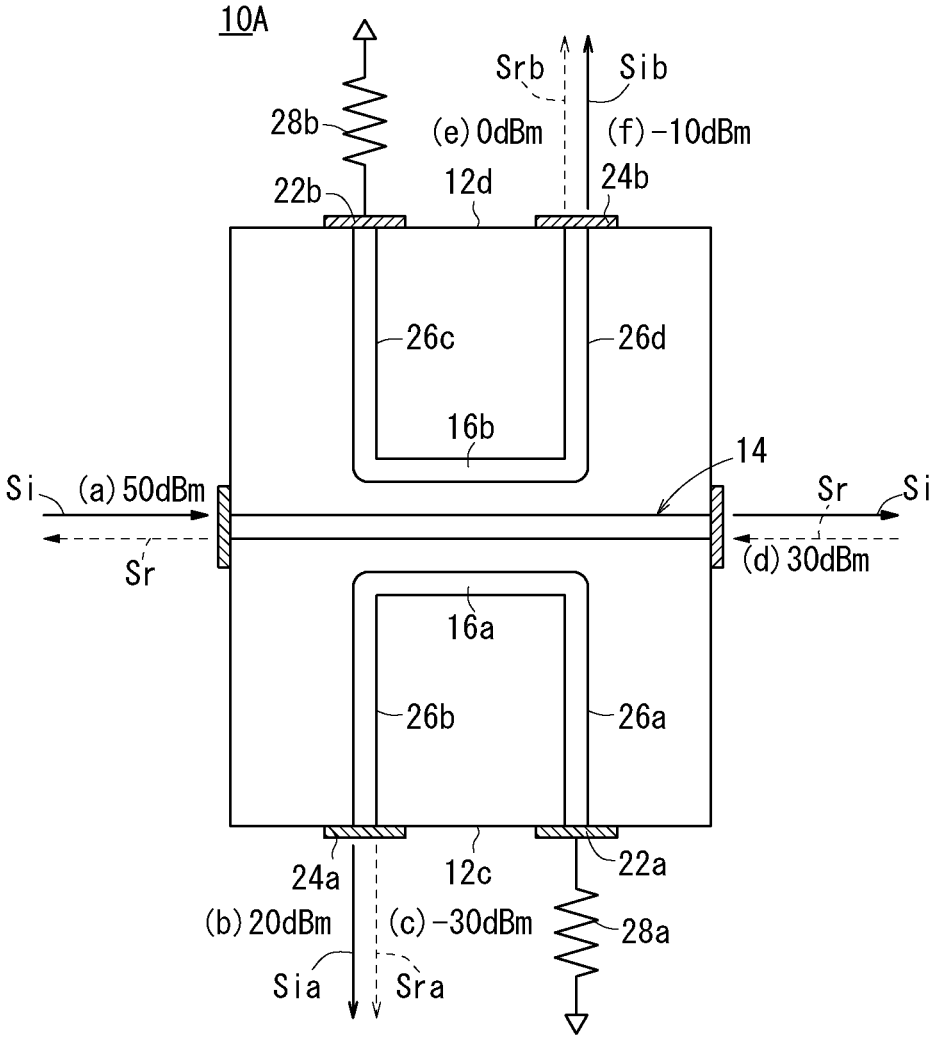
FIG. 6 is a view showing the manner in which the first directional coupler operates.

In FIG. 6, when the reflected level is lowered, the level of the input leakage signal Sib may become greater than the level of the reflection monitor signal Srb that is output from the second monitor connection terminal 24*b*, possibly failing to properly evaluate the reflected signal Sr. For example, (d): when the reflected level is not 30 dBm, but 10 dBm, (e): the level of the reflection monitor signal Srb is −20 dBm, (f): smaller than the level of the input leakage signal Sib which is −10 dBm, and (e): the level of the reflection monitor signal Srb may not be properly evaluated. In order to avoid such a drawback, it is important to increase the level of the second isolation (the isolation between the main line 14 and the second coupling line 16*b*). Since the second coupling length L2 is greater than the first coupling length L1 on the fifth directional coupler 10E, the level of the second isolation is increased to allow the reflected signal Sr to be monitored accurately even when the reflected level is low.

A directional coupler according to a sixth embodiment (hereinafter referred to as "sixth directional coupler 10F") will be described below with reference to FIG. 13.

Figure 13:
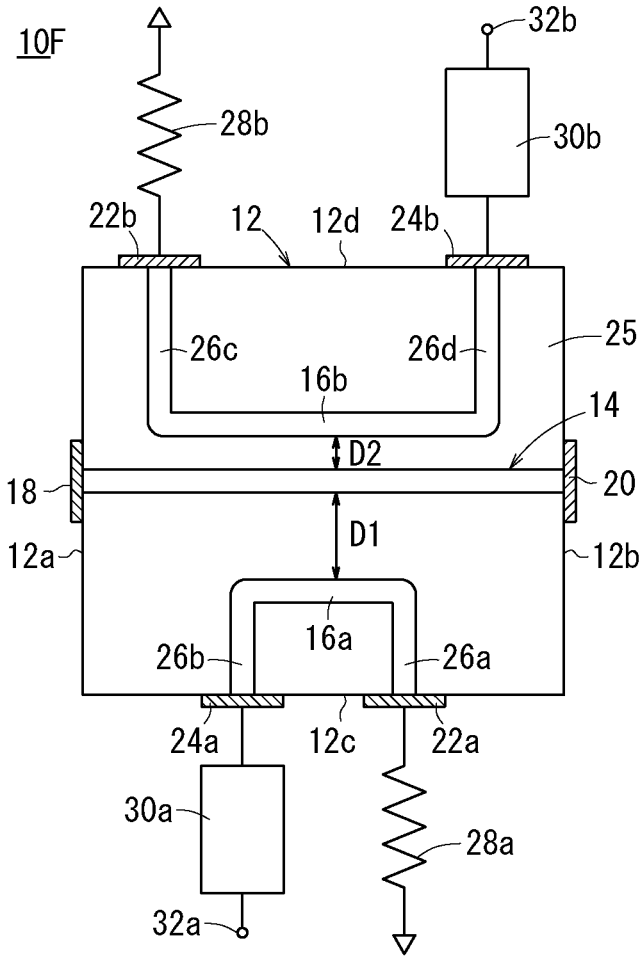
FIG. 13 is a plan view showing an example of various lines of a sixth directional coupler.

The sixth directional coupler 10F is substantially similar in structure to the fifth directional coupler 10E described above, but is different therefrom in that, as shown in FIG. 13, if the shortest distance from the first coupling line 16*a* to the main line 14 is represented by D1 and the shortest distance from the second coupling line 16*b* to the main line 14 is represented by D2, then these shortest distances are related to each other as D1>D2.

Operation of the sixth directional coupler 10F will be described below with reference to FIGS. 6 and 13.

The first monitor circuit 30*a* is connected to the first monitor connection terminal 24*a*, and the second monitor circuit 30*b* is connected to the second monitor connection terminal 24*b*. In order to simplify the circuit arrangement of the first monitor circuit 30*a* and the second monitor circuit 30*b*, it is necessary to keep low the level of the monitored signal because if the input level is too high, the first PIN diode Da causes distortions. In FIG. 6, (b): if it is assumed that the first monitor circuit 30*a* is simplified, the level of the input monitor signal Sia which is 20 dBm is too high. It is preferable to keep low the level of the first coupling (the coupling between the main line 14 and the first coupling line 16*a*). In FIG. 6, if the level of the first coupling is −40 dB, then (b): the level of the input monitor signal Sia is 10 dBm, allowing the simple circuit arrangement to be able to monitor the input signal Si.

If the level of the second coupling (the coupling between the main line 14 and the second coupling line 16*b*) is lowered, then (e): the level of the reflection monitor signal Srb is reduced and (f): becomes lower than the level of the input leakage signal Sib. Therefore, the directional coupler tends to fail to perform its function to monitor the reflected signal Sr. In other words, there is a limitation on the reduction of the second coupling.

With the sixth directional coupler 10F, as the shortest distance D1 from the first coupling line 16*a* to the main line 14 is greater than the shortest distance D2 from the second coupling line 16*b* to the main line 14, the level of the first coupling (the coupling between the main line 14 and the first coupling line 16*a*) is lowered, making it possible to simplify the first monitor circuit 30*a* and the second monitor circuit 30*b* and reliably monitor the input signal Si and the reflected signal Sr.

A directional coupler according to a seventh embodiment (hereinafter referred to as "seventh directional coupler 10G") will be described below with reference to FIG. 14.

Figure 14:
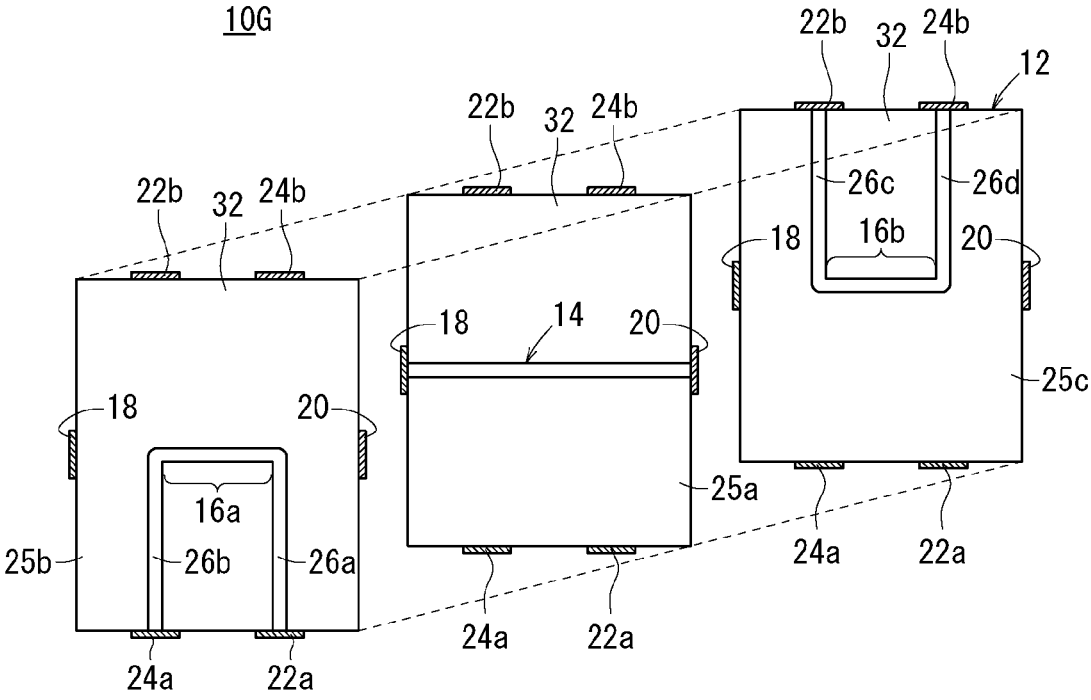
FIG. 14 is a plan view showing an example of various lines of a seventh directional coupler.

The seventh directional coupler 10G is substantially similar in structure to the first directional coupler 10A described above, but is different therefrom in that, as shown in FIG. 14, the main line 14 is disposed on a first plane surface 25*a* in the dielectric substrate 12, the first coupling line 16*a*, the first connection line 26*a*, and the second connection line 26*b* are disposed on a second plane surface 25*b* different from the first plane surface 25*a* in the dielectric substrate 12, and the second coupling line 16*b*, the third connection line 26*c*, and the fourth connection line 26*d* are disposed on a third plane surface 25*c* different from the first plane surface 25*a* and the second plane surface 25*b* in the dielectric substrate 12.

Specifically, the main line 14 is opposed to the first coupling line 16*a* and the second coupling line 16*b* with respective dielectric layers 32 interposed therebetween, and hence can be coupled stronger than they extend parallel to each other on one surface. The first coupling line 16*a* for detecting the input signal Si (the output signal from the radio-frequency amplifier 36) and the second coupling line 16*b* for detecting the reflected signal Sr (the reflected signal from the antenna) should preferably be disposed above and below the main line 14 to prevent their signals from leaking to each other.

A directional coupler according to an eighth embodiment (hereinafter referred to as "eighth directional coupler 10H") will be described below with reference to FIG. 15.

Figure 15:
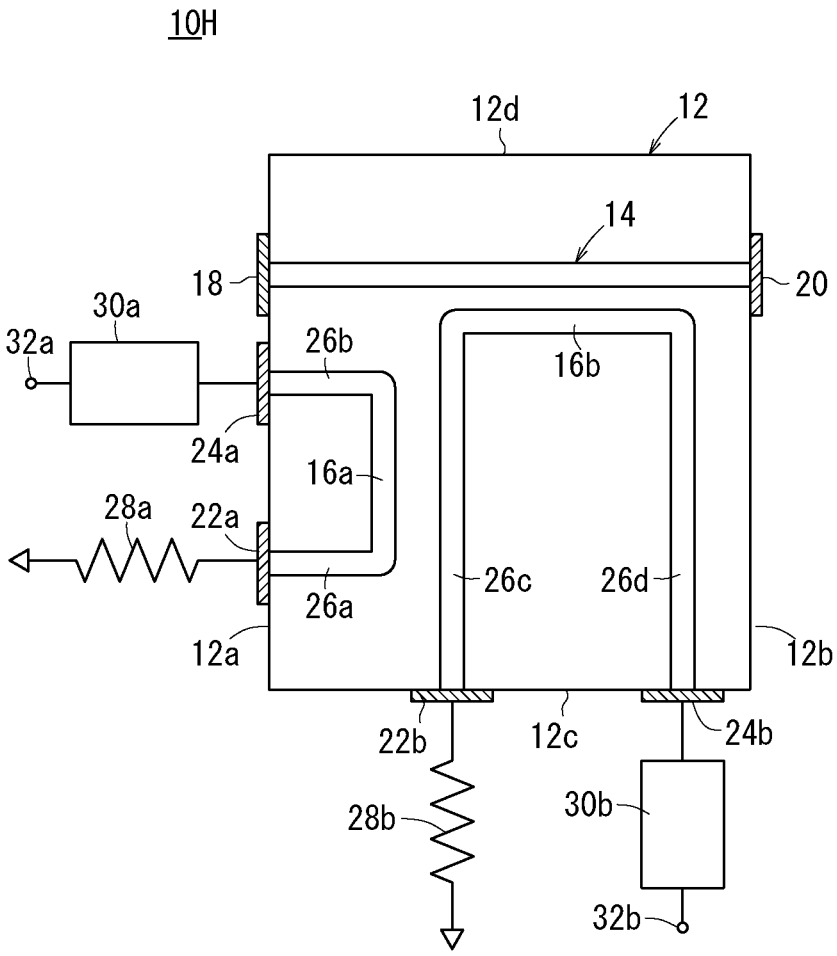
FIG. 15 is a plan view showing an example of various lines of an eighth directional coupler.

The eighth directional coupler 10H is substantially similar in structure to the first directional coupler 10A described above, but is different therefrom as follows:

As shown in FIG. 15, the second terminator connection terminal 22*b* is disposed on the third side face 12*c* of the dielectric substrate 12 near the input side thereof and the second monitor connection terminal 24*b* is disposed on the third side face 12*c* of the dielectric substrate 12 near the output side thereof.

The second coupling line 16*b* lies parallel to and is disposed adjacent to the main line 14. The third connection line 26*c* extends from an end of the second coupling line 16*b* near the input terminal 18 to the second terminator connection terminal 22*b*. The fourth connection line 26*d* extends from the other end of the second coupling line 16*b* near the output terminal 20 to the second monitor connection terminal 24*b*.

In addition to the input terminal 18, the first monitor connection terminal 24*a* is disposed on the first side face 12*a* of the dielectric substrate 12 at a position near the input terminal 18, and the first terminator connection terminal 22*a* is disposed on the first side face 12*a* in the neighborhood of the first monitor connection terminal 24*a*.

The first coupling line 16*a* lies parallel to and is disposed adjacent to the third connection line 26*c*. The first connection line 26*a* extends from an end of the first coupling line 16*a* remote from the main line 14 to the first terminator connection terminal 22*a*. The second connection line 26*b* extends from the other end of the first coupling line 16*a* near the main line 14 to the first monitor connection terminal 24*a*.

Operation of the eighth directional coupler 10H will be described below. A portion of an input signal Si appears on the second terminating resistor 28*b* through the third connection line 26*c*. It is thus possible to monitor the input signal Si via the first coupling line 16*a* parallel to the third connection line 26*c* and the first monitor connection terminal 24*a*.

It may be proposed to connect the first monitor circuit 30*a* in place of the second terminating resistor 28*b* connected to the second terminator connection terminal 22*b*. However, terminating conditions are not maintained, and the impedance value of the first monitor circuit 30*a* is not the same as the terminating resistor. Therefore, the isolation between the main line 14 and the second coupling line 16*b* is degraded, causing the second monitor circuit 30*b* to fail to perform its function to monitor the reflected signal Sr. As shown in FIG. 15, it is preferable to position the first coupling line 16*a* adjacent to the third connection line 26*c*.

A directional coupler according to a ninth embodiment (hereinafter referred to as "ninth directional coupler 10I") will be described below with reference to FIG. 16.

Figure 16:
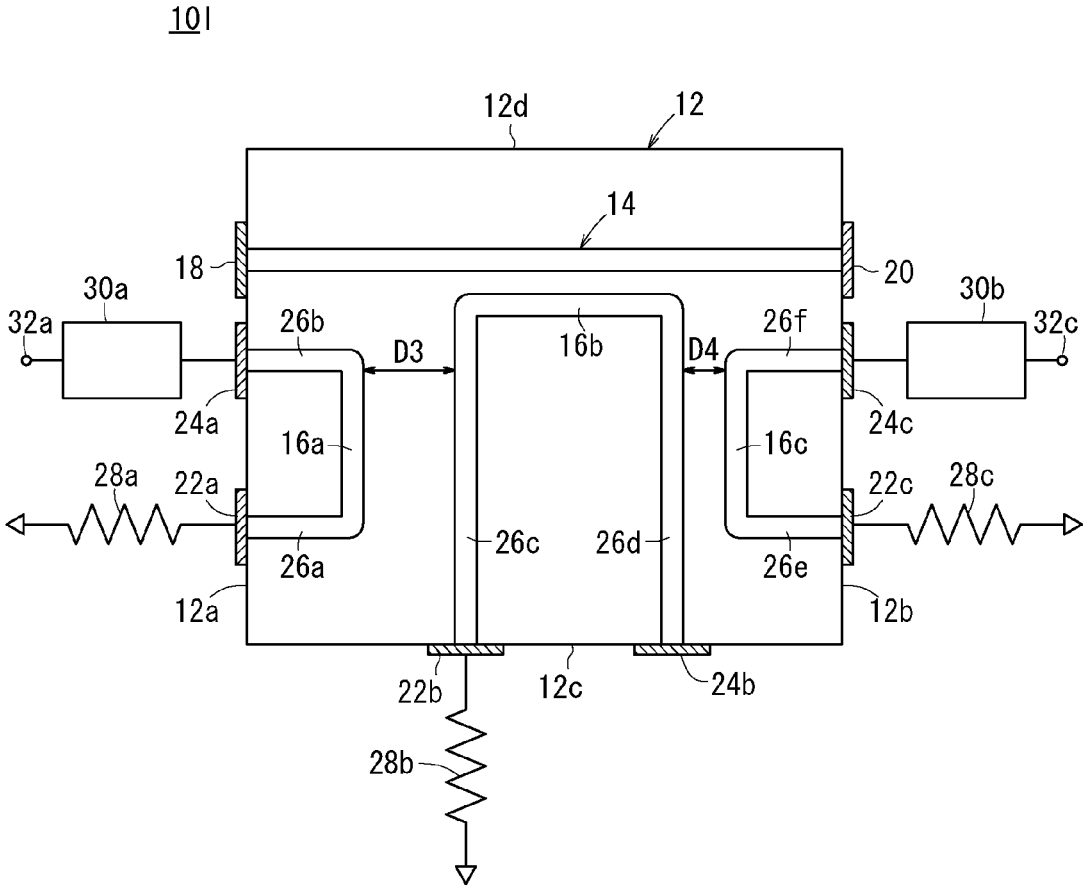
FIG. 16 is a plan view showing an example of various lines of a ninth directional coupler.

The ninth directional coupler 10I is substantially similar in structure to the eighth directional coupler 10H described above, but is different therefrom as follows:

As shown in FIG. 16, a third coupling line 16*c* lies parallel to and is disposed adjacent to the fourth connection line 26*d*. In addition to the output terminal 20, a third monitor connection terminal 24*c* is disposed on the second side face 12*b* of the dielectric substrate 12 at a position near the output terminal 20, and a third terminator connection terminal 22*c* is disposed on the second side face 12*b* in the neighborhood of the third monitor connection terminal 24*c*.

A fifth connection line 26*e* extends from an end of the third coupling line 16*c* remote from the main line 14 to the third terminator connection terminal 22*c*. A sixth connection line 26*f* extends from the other end of the third coupling line 16*c* near the main line 14 to the third monitor connection terminal 24*c*.

A third terminating resistor 28*c* is connected to the third terminator connection terminal 22*c*, and the second monitor circuit 30*b* is connected between the third monitor connection terminal 24*c* and a third monitor output terminal 32*c*.

If the shortest distance from the third connection line 26*c* to the first coupling line 16*a* is represented by D3 and the shortest distance from the fourth connection line 26*d* to the third coupling line 16*c* is represented by D4, then these shortest distances are related to each other as D3>D4.

The ninth directional coupler 10I thus arranged is based on the assumption that the first monitor circuit 30*a* is simplified, as with the sixth directional coupler 10F (see FIG. 13). The level of the first coupling (the coupling between the third connection line 26*c* and the first coupling line 16*a*) is lowered, allowing the simple circuit arrangement to be able to monitor the input signal Si.

A directional coupler according to a tenth embodiment (hereinafter referred to as "tenth directional coupler 10J") will be described below with reference to FIG. 17.

Figure 17:
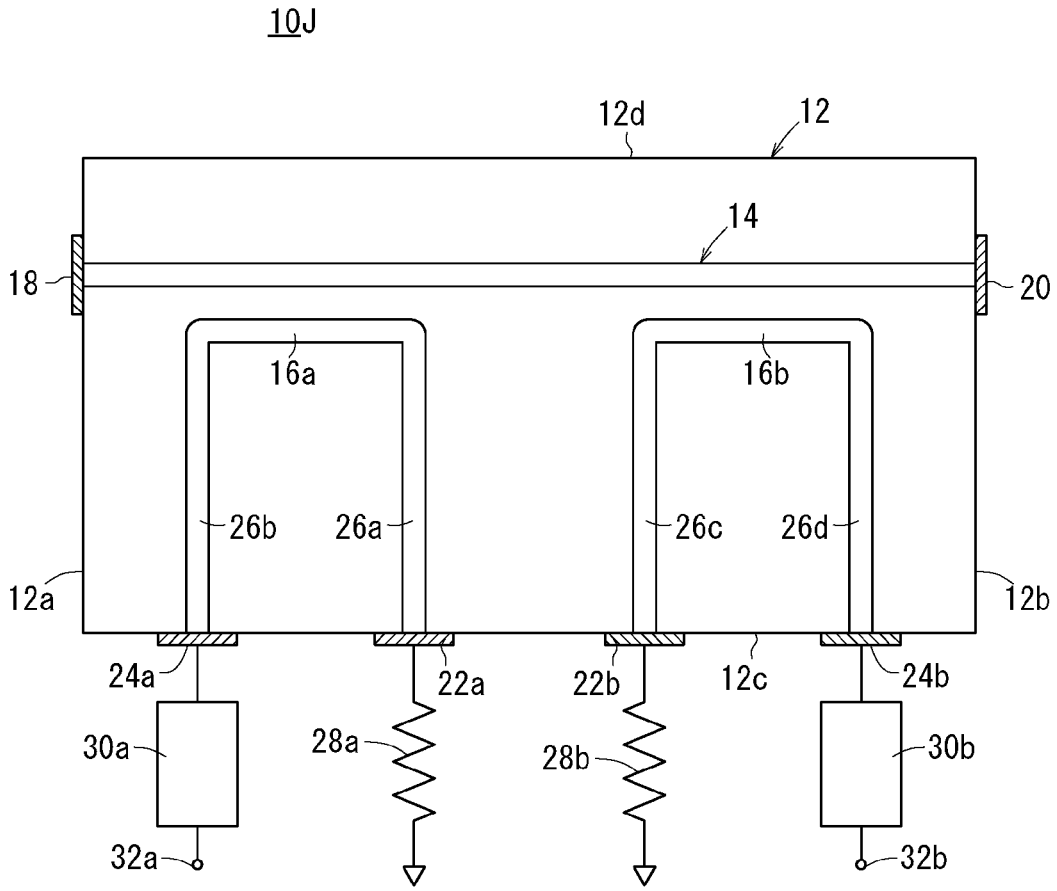
FIG. 17 is a plan view showing an example of various lines of a tenth directional coupler.

The tenth directional coupler 10J is substantially similar in structure to the first directional coupler 10A described above, but is different therefrom as follows:

As shown in FIG. 17, the first coupling line 16*a*, the first connection line 26*a*, and the second connection line 26*b*, and the second coupling line 16*b*, the third connection line 26*c*, and the fourth connection line 26*d* are oriented in the same direction. The first coupling line 16*a* is disposed near the input terminal 18, and the second coupling line 16*b* is disposed near the output terminal 20.

The first monitor connection terminal 24*a* is disposed on the third side face 12*c* of the dielectric substrate 12 at a position near the input side, and the first terminator connection terminal 22*a* is disposed on the third side face 12*c* in the neighborhood of the first monitor connection terminal 24*a*. The second monitor connection terminal 24*b* is disposed on the third side face 12*c* of the dielectric substrate 12 at a position near the output side, and the second terminator connection terminal 22*b* is disposed on the third side face 12*c* in the neighborhood of the second monitor connection terminal 24*b*.

The tenth directional coupler 10J can be mounted in a smaller area than the two directional couplers 100 (100A and 100B) shown in FIG. 2. However, the main line 14 is somewhat longer than the main line 14 in the first directional coupler 10A. Through the longer main line 14 is less effective in reducing the insertion loss, the tenth directional coupler 10J is advantageous in applications where the positions of terminals are to be concentrated on one side.

Figure 18:
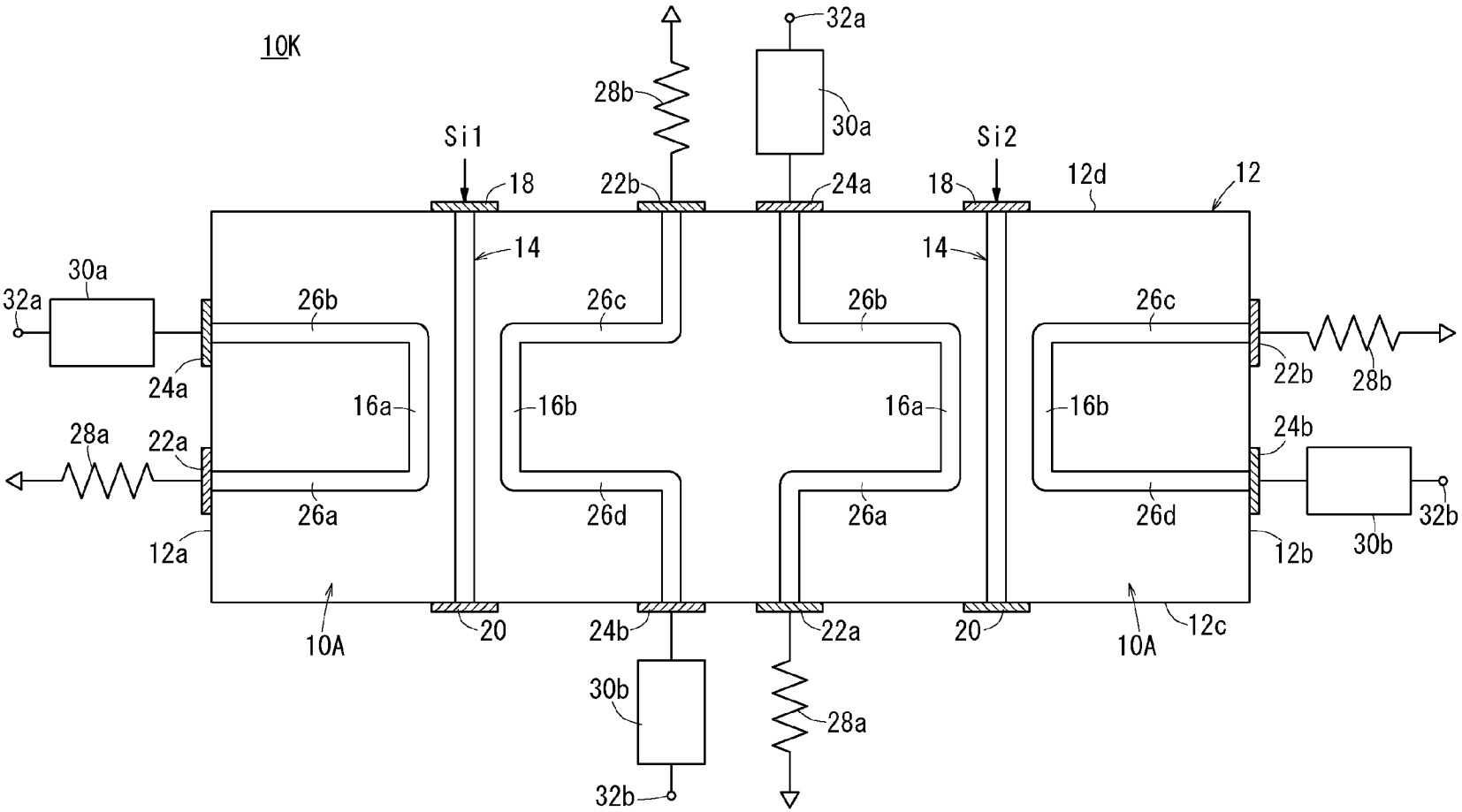
FIG. 18 is a plan view showing an example of various lines of an eleventh directional coupler.

A directional coupler according to an eleventh embodiment (hereinafter referred to as "eleventh directional coupler 10K") will be described below with reference to FIG. 18.

The eleventh directional coupler 10K comprises two first directional couplers 10A disposed parallel to each other on one dielectric substrate 12.

Of output signals (a first output signal and a second output signal) from two radio-frequency amplifiers, for example, the first output signal is input as a first input signal Si1 to one main line 14, and the second output signal is input as a second input signal Si2 to the other main line 14. The single eleventh directional coupler 10K is thus capable of monitoring two input signals and two reflected signals.

Though the two first directional couplers 10A are illustrated as being disposed parallel to each other, three or more first directional couplers 10A may be disposed parallel to each other.

Figure 19:
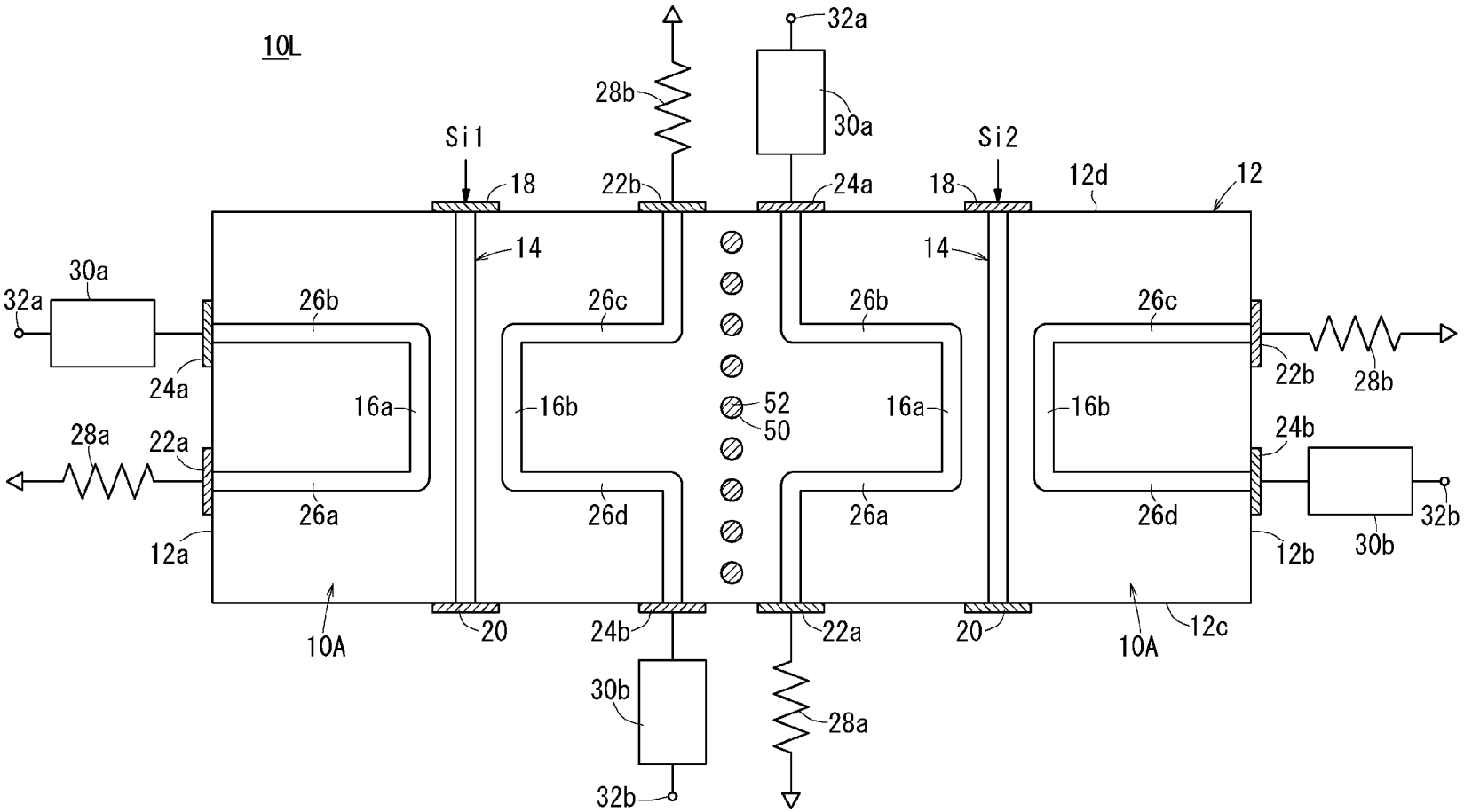
FIG. 19 is a plan view showing an example of various lines of a twelfth directional coupler.

A directional coupler according to a twelfth embodiment (hereinafter referred to as "twelfth directional coupler 10L") will be described below with reference to FIG. 19.

The twelfth directional coupler 10L is substantially similar in structure to the eleventh directional coupler 10K described above, but is different therefrom in that a plurality of through holes 50 are defined in the dielectric substrate 12 between the two first directional couplers 10A and are filled up with ground electrodes 52.

The through holes 50 can reduce an electric coupling between the fourth connection line 26*d* and the first connection line 26*a* and also an electric coupling between the third connection line 26*c* and the second connection line 26*b*, which are adjacent to each other.

The twelfth directional coupler 10L may include three or more first directional couplers 10A disposed parallel to each other.

Figure 20:
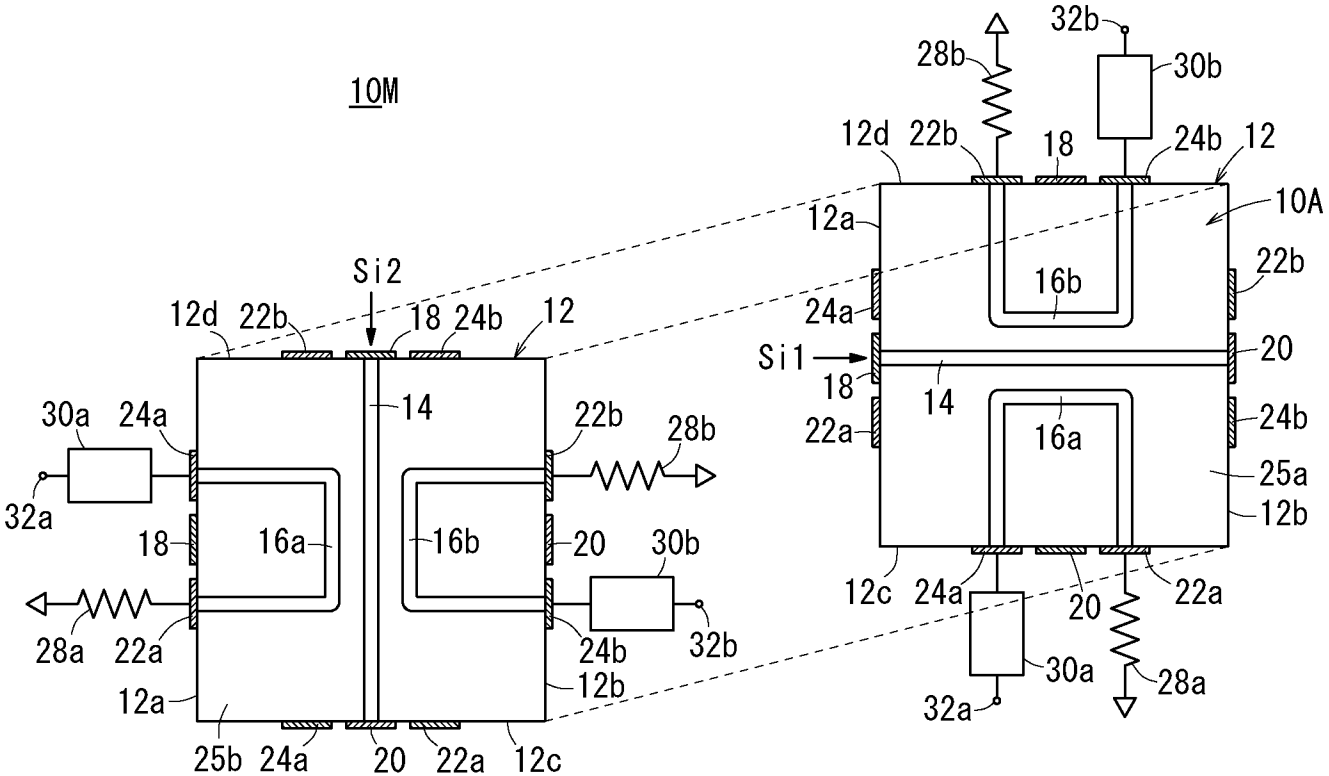
FIG. 20 is a plan view showing an example of various lines of a thirteenth directional coupler.

A directional coupler according to a thirteenth embodiment (hereinafter referred to as "thirteenth directional coupler 10M") will be described below with reference to FIG. 20.

The thirteenth directional coupler 10M comprises two first directional couplers 10A stacked together in one dielectric substrate 12. Specifically, one of the first directional couplers 10A is disposed on a first plane surface 25*a* in the dielectric substrate 12, and the other first directional coupler 10A is disposed on a second plane surface 25*b* different from the first plane surface 25*a* in the dielectric substrate 12. A shield layer (ground electrode or the like) is interposed between the stacked first directional couplers 10A.

The input terminal 18 of the one first directional coupler 10A, and the first terminator connection terminal 22*a* and the first monitor connection terminal 24*a* of the other first directional coupler 10A are disposed on the first side face 12*a* of the dielectric substrate 12. The output terminal 20 of the one first directional coupler 10A, and the second terminator connection terminal 22*b* and the second monitor connection terminal 24*b* of the other first directional coupler 10A are disposed on the second side face 12*b* of the dielectric substrate 12.

Similarly, the output terminal 20 of the other first directional coupler 10A, and the first terminator connection terminal 22*a* and the first monitor connection terminal 24*a* of the one first directional coupler 10A are disposed on the third side face 12*c* of the dielectric substrate 12. The input terminal 18 of the other first directional coupler 10A, and the second terminator connection terminal 22*b* and the second monitor connection terminal 24*b* of the one first directional coupler 10A are disposed on the fourth side face 12*d* of the dielectric substrate 12.

As with the eleventh directional coupler 10K and the twelfth directional coupler 10L, of output signals (a first output signal and a second output signal) from two radio-frequency amplifiers, for example, the first output signal is input as a first input signal Si1 to one main line 14, and the second output signal is input as a second input signal Si2 to the other main line 14. The single thirteenth directional coupler 10M is thus capable of monitoring two input signals and two reflected signals.

Though the two first directional couplers 10A are illustrated as being stacked together, three or more first directional couplers 10A may be stacked together with shield layers interposed therebetween.

Figure 21:
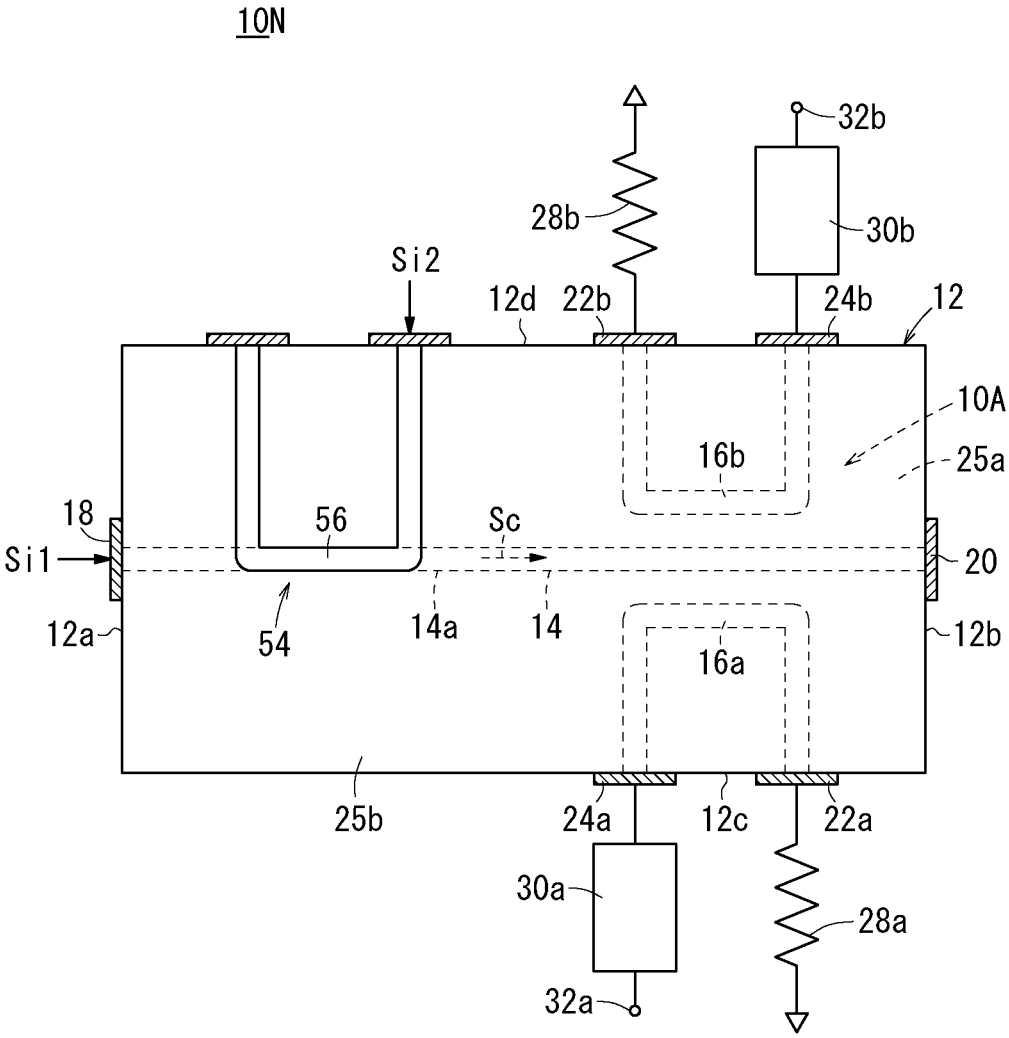
FIG. 21 is a plan view showing an example of various lines of a fourteenth directional coupler.

A directional coupler according to a fourteenth embodiment (hereinafter referred to as "fourteenth directional coupler 10N") will be described below with reference to FIG. 21.

The fourteenth directional coupler 10N comprises a combinational directional coupler 54 for combining two signals and a first directional coupler 10A which are stacked together in the dielectric substrate 12.

The combinational directional coupler 54 comprises an extended portion 14*a* of the main line 14 of the first directional coupler 10A which is disposed on a first plane surface 25*a* in the dielectric substrate 12, and a combinational coupling line 56 which is disposed on a second plane surface 25*b* different from the first plane surface 25*a* in the dielectric substrate 12 and which is opposed to the extended portion 14*a* of the main line 14 with a dielectric layer interposed therebetween.

Of output signals (a first output signal and a second output signal) from two radio-frequency amplifiers, for example, the first output signal is input as a first input signal Si1 to one main line 14, and the second output signal is input as a second input signal Si2 to the combinational coupling line 56. The combinational directional coupler 54 combines the first input signal Si1 and the second input signal Si2 into a combined signal Sc, which is input to the first directional coupler 10A. As a result, the first directional coupler 10A can monitor the combined signal Sc and also can monitor a reflected signal of the combined signal Sc.

Though the single combinational coupling line 56 is opposed to the main line 14 for combining two input signals in the illustrated embodiment, two or more combinational coupling lines 56 may be opposed to the main line 14 for combining three or more input signals.

In the first through fourteenth directional couplers 10A through 10N described above, the dielectric substrate 12 should preferably be made of ceramics to make the directional couplers smaller in size depending on the dielectric constant of ceramics. The dielectric substrate of ceramics provides more stable characteristics at high temperatures than if the dielectric substrate 12 is made of resin. The stable characteristics in a high temperature range are advantageous because the circuit temperature of the radio-frequency amplifier 36 rises due to its output signal.

EXAMPLES

1. Conventional Example

An inner layer conductive pattern as shown in FIG. 1B was printed using a silver paste on a ceramics green sheet of ceramics having a dielectric constant of 7. A prescribed number of such ceramics green sheets were compressed and stacked together, and then fired at about 950° C. Then, terminal electrodes were printed on the four side faces, thus fabricating an integral directional coupler 100 as shown in FIG. 1A.

The fabricated directional coupler 100 had a vertical dimension of 7.0 mm, a horizontal dimension of 9.0 mm, and a thickness of 2.5 mm, had a coupling of 30 dB and an isolation of 60 dB, and had an insertion loss of 0.08 dB because of its main line 104.

Two such directional couplers 100 (100A and 100B) were prepared, and mounted on a wiring board in series with the output terminal of the radio-frequency amplifier 120 as shown in FIG. 2.

A signal of −30 dB output from the radio-frequency amplifier 120 was observed from the coupling terminal of the directional coupler 100A for monitoring the output signal, and the reflected signal from the antenna was of −60 dB. The directional coupler 100B for monitoring the reflected signal observed a reflected signal of −30 dB and a signal of −60 dB output from the radio-frequency amplifier 120. The directional couplers 100A, 100B thus observed the output signal from the radio-frequency amplifier 120 and the reflected signal from the antenna.

The two directional couplers 100A, 100B that were connected to each other caused an overall loss of 0.16 dB.

2. Inventive Example 1

An inner layer conductive pattern as shown in FIG. 4 was printed using a silver paste on a ceramics green sheet of ceramics having a dielectric constant of 7. A prescribed number of such ceramics green sheets were compressed and stacked together, and then fired at about 950° C. Then, terminal electrodes were printed on the four side faces, thus fabricating an integral first directional coupler 10A as shown in FIG. 3.

The fabricated first directional coupler 10A had a vertical dimension of 7.0 mm, a horizontal dimension of 14.0 mm, and a thickness of 2.5 mm. The first directional coupler disposed in one dielectric substrate 12 had a first coupling and a second coupling each of 30 dB, a first isolation and a second isolation each of 60 dB, and had an insertion loss of 0.09 dB because of its main line 14.

The first directional coupler 10A was mounted on a wiring board as shown in FIG. 5.

A signal of −30 dB (input monitor signal Sia) output from the radio-frequency amplifier 36 was observed from the first monitor connection terminal 24*a*, and the reflection leakage signal Sra from the antenna was of −60 dB. The second monitor connection terminal 24*b* observed a reflected signal (reflection monitor signal Srb) of −30 dB and a signal (input leakage signal Sib) of −60 dB output from the radio-frequency amplifier 36. The first directional coupler 10A thus monitored the output signal (input signal Si) from the radio-frequency amplifier 36 and the reflected signal Sr from the antenna.

The present circuit arrangement caused a loss of 0.09 dB corresponding to that of the single directional coupler 100.

Although certain preferred embodiments of the present invention have been shown and described in detail, it should be understood that various changes and modifications may be made therein without departing from the scope of the appended claims.

What is claimed is:

1. A directional coupler comprising:

a dielectric substrate having at least an input terminal and an output terminal on a surface thereof;

a main line disposed in the dielectric substrate and extending between the input terminal and the output terminal;

a first coupling line for monitoring a level of an input signal which is input through the input terminal, the first coupling line being disposed in the dielectric substrate and having an end electrically connected to a first terminating resistor; and a second coupling line for monitoring a level of a reflected signal which is input through the output terminal, the second coupling line being disposed in the dielectric substrate and having an end electrically connected to a second terminating resistor.

2. The directional coupler according to claim 1, wherein the first coupling line includes at least a portion lying parallel to the main line;

the second coupling line includes at least a portion lying parallel to the main line;

the first terminating resistor is connected to the end of the first coupling line which is close to the output terminal; and the second terminating resistor is connected to the end of the second coupling line which is close to the input terminal.

3. The directional coupler according to claim 2, wherein the first coupling line and the second coupling line lie parallel to the main line.

4. The directional coupler according to claim 2, wherein the first coupling line and the second coupling line include portions not parallel to the main line.

5. The directional coupler according to claim 2, wherein the main line, the first coupling line, and the second coupling line are disposed on one plane surface in the dielectric substrate.

6. The directional coupler according to claim 2, wherein the main line, the first coupling line, and the second coupling line are not disposed on one plane surface in the dielectric substrate.

7. The directional coupler according to claim 6, wherein the main line is disposed on a first plane surface in the dielectric substrate;

the first coupling line is disposed on a second plane surface different from the first plane surface in the dielectric substrate; and the second coupling line is disposed on a third plane surface different from the first plane surface and the second plane surface in the dielectric substrate.

8. The directional coupler according to claim 2, wherein a portion of the first coupling line which is coupled to the main line and a portion of the second coupling line which is coupled to the main line extend along the main line, and the portion of the first coupling line which is coupled to the main line and the portion of the second coupling line which is coupled to the main line cross a plane perpendicular to the main line.

9. The directional coupler according to claim 2, wherein the first coupling line and the second coupling line are axisymmetric with respect to the main line.

10. The directional coupler according to claim 2, wherein a shortest distance from the first coupling line to the input terminal and a shortest distance from the second coupling line to the input terminal are different from each other.

11. The directional coupler according to claim 10, wherein the first coupling line is disposed close to the input terminal, and the second coupling line is disposed close to the output terminal.

12. The directional coupler according to claim 2, wherein the first coupling line and the second coupling line have different lengths, respectively.

13. The directional coupler according to claim 12, wherein the length of the second coupling line is greater than the length of the first coupling line.

14. The directional coupler according to claim 2, wherein a shortest distance from the first coupling line to the main line and a shortest distance from the second coupling line to the main line are different from each other.

15. The directional coupler according to claim 14, wherein the shortest distance from the first coupling line to the main line is greater than the shortest distance from the second coupling line to the main line.

16. The directional coupler according to claim 2, wherein the first coupling line and the second coupling line have respective lengths which are not equal to each other, and a shortest distance from the first coupling line to the main line and a shortest distance from the second coupling line to the main line are not equal to each other.

17. The directional coupler according to claim 16, wherein the length of the second coupling line is greater than the length of the first coupling line, and the shortest distance from the first coupling line to the main line is greater than the shortest distance from the second coupling line to the main line.

18. The directional coupler according to claim 2, further comprising:

a first monitor circuit for monitoring the level of the input signal, the first monitor circuit being electrically connected to another end of the first coupling line; and a second monitor circuit for monitoring the level of the reflected signal, the second monitor circuit being electrically connected to another end of the second coupling line.

19. The directional coupler according to claim 18, further comprising:

a first terminator connection terminal and a first monitor connection terminal which are disposed on a first side face of the dielectric substrate;

a second terminator connection terminal and a second monitor connection terminal which are disposed on a second side face which is opposed to the first side face of the dielectric substrate;

a first connection line electrically connecting the end of the first coupling line to the first terminator connection terminal;

a second connection line electrically connecting the other end of the first coupling line to the first monitor connection terminal;

a third connection line electrically connecting the end of the second coupling line to the second terminator connection terminal; and a fourth connection line electrically connecting the other end of the second coupling line to the second monitor connection terminal;

wherein the first terminating resistor is connected to the first terminator connection terminal;

the first monitor circuit is connected to the first monitor connection terminal;

the second terminating resistor is connected to the second terminator connection terminal; and the second monitor circuit is connected to the second monitor connection terminal.

20. The directional coupler according to claim 19, wherein the first connection line and the second connection line extend perpendicularly to the main line and have respective lengths greater than a length of coupled portion of the main line and the first coupling line; and the third connection line and the fourth connection line extend perpendicularly to the main line and have respective lengths greater than the length of coupled portions of the main line and the second coupling line.

21. The directional coupler according to claim 18, wherein a portion of the first monitor circuit and a portion of the second monitor circuit are mounted on an upper surface of the dielectric substrate.

22. The directional coupler according to claim 18, wherein a portion of the first monitor circuit, a portion of the second monitor circuit, the first terminating resistor, and the second terminating resistor are mounted on an upper surface of the dielectric substrate.

23. The directional coupler according to claim 22, further comprising:

a first terminator connection terminal and a first monitor output terminal which are disposed on a first side face of the dielectric substrate; and a second terminator connection terminal and a second monitor output terminal which are disposed on a second side face which is opposed to the first side face of the dielectric substrate;

wherein the portion of the first monitor circuit which is mounted on the upper surface of the dielectric substrate and the first monitor output terminal are electrically connected to each other through an interconnect layer disposed on the upper surface of the dielectric substrate;

the first terminating resistor which is mounted on the upper surface of the dielectric substrate and the first terminator connection terminal are electrically connected to each other through an interconnect layer disposed on the upper surface of the dielectric substrate;

the portion of the second monitor circuit which is mounted on the upper surface of the dielectric substrate and the second monitor output terminal are electrically connected to each other through an interconnect layer disposed on the upper surface of the dielectric substrate; and the second terminating resistor which is mounted on the upper surface of the dielectric substrate and the second terminator connection terminal are electrically connected to each other through an interconnect layer disposed on the upper surface of the dielectric substrate.

24. The directional coupler according to claim 23, wherein the first monitor circuit includes a first coupling capacitor connected to the other end of the first coupling line;

the second monitor circuit includes a second coupling capacitor connected to the other end of the second coupling line;

the first coupling capacitor comprises a first electrode disposed in the dielectric substrate and connected to the other end of the first coupling line through a first via hole, a second electrode disposed in the dielectric substrate and connected to the portion of the first monitor circuit through a second via hole, and a dielectric layer interposed between the first electrode and the second electrode; and the second coupling capacitor comprises a third electrode disposed in the dielectric substrate and connected to the other end of the second coupling line through a third via hole, a fourth electrode disposed in the dielectric substrate and connected to the portion of the second monitor circuit through a fourth via hole, and a dielectric layer interposed between the third electrode and the fourth electrode.

25. The directional coupler according to claim 1, further comprising:

a terminator connection terminal disposed on a side face of the dielectric substrate at a position near the input terminal;

a monitor connection terminal disposed on the side face of the dielectric substrate at a position near the output terminal;

an input connection line electrically connecting the end of the second coupling line which has at least a portion lying parallel to the main line, to the terminator connection terminal; and an output connection line electrically connecting another end of the second coupling line to the monitor connection terminal;

wherein the first coupling line includes at least a portion lying parallel to the input connection line and has another end positioned near the main line.

26. The directional coupler according to claim 25, further comprising a third coupling line for monitoring the level of the reflected signal which is input through the output terminal, the third coupling line being disposed in the dielectric substrate and having an end electrically connected to a third terminating resistor, wherein the third coupling line includes at least a portion lying parallel to the output connection line and has another end positioned near the main line.

27. The directional coupler according to claim 26, wherein a shortest distance from the first coupling line to the second coupling line is greater than a shortest distance from the third coupling line to the second coupling line.

28. The directional coupler according to claim 1, wherein the dielectric substrate is made of ceramics.

* * * * *